US007338541B2

(12) United States Patent
Connor et al.

(10) Patent No.: US 7,338,541 B2
(45) Date of Patent: Mar. 4, 2008

(54) SYNTHETIC JET FUEL AND DIESEL FUEL COMPOSITIONS AND PROCESSES

(75) Inventors: Daniel Stedman Connor, Cincinnati, OH (US); James Charles Theophile Roger Burckett-St. Laurent, Lasne (BE); Thomas Anthony Cripe, Loveland, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 720 days.

(21) Appl. No.: 10/288,966

(22) Filed: Nov. 6, 2002

(65) Prior Publication Data

US 2004/0016174 A1 Jan. 29, 2004

Related U.S. Application Data

(60) Provisional application No. 60/331,825, filed on Nov. 20, 2001.

(51) Int. Cl.
*C10L 1/18* (2006.01)

(52) U.S. Cl. ..... 44/451; 44/400; 44/389; 44/445

(58) Field of Classification Search ..... 44/451, 44/445, 389, 400; 568/840
See application file for complete search history.

(56) References Cited

U.S. PATENT DOCUMENTS 3,033,889 A * 5/1962 Enyeart et al. ..... 558/186
4,440,656 A 4/1984 Horodysky
5,730,029 A 3/1998 Stoldt et al.
6,706,931 B2 * 3/2004 Edwards ..... 568/671
6,896,708 B2 5/2005 Connor et al.

FOREIGN PATENT DOCUMENTS

GB 719 445 12/1954
JP 08283753 * 10/1996

OTHER PUBLICATIONS

Aviation and Other Gas Turbine Fuels, Kirk-Othmer Encyclopedia Of Chemical Technology, 1992, 788-812, vol. 3, Wiley, NY.
Gasoline And Other Fuels, Kirk-Othmer Encyclopedia Of Chemical Technology , 1994, 373-388, vol. 12, Wiley, NY.
The Diesel Challenge, The Chemical Engineer, 1997, 28-32, Issue 632.
J. Scherzer, A. Gruia, Hydrocracking Processes, 1996, 174-199, Marcel Dekker, NY.
R.G. Brownlee, R.M. Silverstein, A Micro-Preparative Gas Chromatograph and a Modified Carbon Skeleton Determinator, Analytical Chemistry, 1968, 2077-2079, vol. 40, No. 13.

(Continued)

*Primary Examiner*—Cephia D. Toomer
(74) *Attorney, Agent, or Firm*—Laura R. Grunzinger

(57) ABSTRACT

Novel clean fuels comprising selected nonlinear long chain saturated primary monohydric/dihydric alcohol derivatives and mixtures thereof; novel diols and/or diol derivatives; and processes for making clean synthetic jet fuels and/or clean synthetic diesel fuels as well as processes for making clean synthetic jet fuels and/or clean synthetic diesel fuels concurrently with making nonlinear alcohols for use by the detergent industry.

38 Claims, 7 Drawing Sheets

OTHER PUBLICATIONS

M. Beroza, R. Sareomtp, Structure Characterization by Microhydrogenation, Analytical Chemistry, 1965, 1042-1044, vol. 37.

M. Inomata, K. Sato, Y. Yamada, H. Sasaki, Engineering Firm Has Designed refinery Of The Future, Oil & Gas Journal, Apr. 28, 1997, 56-65.

J.S. Baum, L. I. Hansen, C. A. Brown, K. E. Marzocco, Batching, Treating Keys To Moving Refinded products in Crude-Oil Line, Oil & Gas Journal, Oct. 5, 1998, 49-55.

L. Linquist, M. Pacheco, Enzyme-Based Diesel Desulfurization Process Offers Energy CO2 Advantages, Oil & Gas Journal, Feb. 22, 1999, 45-48.

S. J. Miller, New Molecular Sieve Process For Lube Dewaxing By Was Isomerization, Microporous Materials, 1994, 439-449.

J. A. Spearot, Advanced Fuel Technology Needed For Future Vehicle Propulsion Systems, Hearing of the Subcommittee on Energy and Environment of the House Science Committee, Oct. 5, 1999.

* cited by examiner

SYNTHETIC JET FUEL AND DIESEL FUEL COMPOSITIONS AND PROCESSES

CROSS REFERENCE TO RELATED APPLICATIONS

This application claims priority under 37 U.S.C. § 119(e) to U.S. Provisional Application Ser. No. 60/331,825, filed Nov. 20, 2001.

FIELD OF THE INVENTION

This invention is in the field of synthetic and/or highly refined fuels, especially synthetic and/or highly refined jet fuels and synthetic and/or highly refined diesel fuels, and processes for making them. More particularly the invention is in the field of low-sulfur or sulfur-free fuels comprising an additive to compensate for sulfur removal.

BACKGROUND OF THE INVENTION

Jet fuels or diesel fuels that are clean and contain substantially no sulfur, nitrogen, or aromatics are expected to be on the verge of a dramatic increase in demand, for example to meet the pressing need of automobile manufacturers for a global standard. See the testimony to the U.S. Congress of Oct. 5, 1999 by James A. Spearot, Director, Chemical and Environmental Sciences Laboratory, General Motors, on behalf of the Partnership for a New Generation of Vehicles Advanced Fuels Group. However there are substantial unsolved technical problems connected with such a development.

Recently developed fuel compositions are cleaner burning, but are seriously deficient in certain fuel-desirable technical attributes. These attributes are apparently lost with the removal of sulfur and/or nitrogen. Accordingly there is a newly emergent need, and corresponding thereto, a significant technical problem to be solved of how to secure improved clean jet or diesel fuel which more effectively compensates for removal of sulfur and/or nitrogen and/or aromatics, especially for removal of sulfur.

Such novel fuels would comply with increasingly stringent regulatory standards, and would be highly sought after by the consumer both for improved environmental acceptability and for lack of compromise in terms of effectiveness. This would be especially true for fuel system lubrication of injectors and fuel pumps in modern engines.

Another growing need in the field of low sulfur jet/diesel fuels (including in general sulfur-free types) is the need for a common or "fungible", i.e., economically interchangeable, fuel/additive or fuel additive "concentrate". Such commonality would permit a relatively small number of specialized plants, such as FISCHER-TROPSCH plants, to serve as a source of supply of a "concentrate" which could be blended in any petroleum refinery with all manner of jet/diesel fuels, especially low-sulfur fuels, including hydrodesulfurized and/or biodesulfurized conventional petroleum fuels as well as FISCHER-TROPSCH derived fuels. Thus the benefit of the additive would be spread over all the principal ultra-low sulfur jet/diesel fuels, and solve for all of them the problems incurred by sulfur-removal. Such a benefit could indeed be material to the protection of the entire base of investment in conventional petroleum refining. Moreover, if the additive were to be a concentrate, the above need would be addressed much more viably and economically.

Unfortunately, known processes for making fuel lubricating additives of the relatively long-chain type required are subject to intrinsically producing too low a level of useful additive, diluted by hydrocarbons which are uneconomical to transport or to remove. Moreover, there is significant room for improvement in the properties of such additives.

Known processes for example include those which produce so called "native" alcohols in a FISCHER-TROPSCH derived fuel. Moreover, the total amount of such "native" alcohols is insufficient when blending to high dilution for modern jet/diesel fuel lubrication. The levels of the native alcohols produced by the FISCHER-TROPSCH processes are inadequate in providing lubricity necessary in modern jet/diesel fuel concentrates or blendstocks. The type and level of branching in the native alcohol is limited; they are mostly linear. Further, in products of such processes, there is no independent variability of branching/heavy atom count in the alcohol as compared to the co-present fuel hydrocarbons, thus no possibility of concurrently optimizing (a) lubricity properties and (b) other important parameters, e.g., cetane number or smoke point. In other words, known process always have the heavy atom count for hydrocarbon equal to the sum of carbon atoms and the heavy atom count for alcohol equal to the sum of carbon and oxygen atoms.

Conventional non-alcohol approaches to additives for low sulfur fuels have been tried and found wanting. State of the art, for example, is represented by WO 96/25473; WO 98/21293; WO 98/28383; WO 99/00467; and U.S. Pat. No. 5,488,191. Such additives have one or more important disadvantages, for example they contain nitrogen, aromatic rings, have overly high molecular weight, or are relatively uneconomical.

Particularly desirable, then, would be a common, concentrated, biodegradable, economical additive which is more lubricious. Ideally, such an additive would be dramatically lower melting than any known additive currently available on commercial scale in concentrate form. Moreover, such a particularly desirable additive would be free from disadvantages such as excessively high molecular weight, and would completely and cleanly combust without any difficulty. Compositions comprising such an additive would permit independent control of the structure of the alcohol derivatives and the structure of the fuel hydrocarbons, for an overall optimization of the fuel properties of mixtures containing both.

Accordingly, it is an object of the present invention to secure such a concentrated additive, derivative low-sulfur- or zero-sulfur-fuels containing it, and processes for making it.

Processes for making jet and/or diesel fuels have been markedly improved in recent years. Such processes include deep hydroprocessing of crudes as well as recently improved FISCHER-TROPSCH slurry bed reactions to convert synthesis gas (syngas) to a wax, followed by hydrocracking/hydroisomerization and distillation to separate the desired fuel streams. The products can be optimized around jet/diesel.

The present invention substantially modifies such processes and compositions, affords novel fuel compositions, including the desired concentrated additive, and solves the aforementioned technical problems.

Compositions of the present invention have numerous advantages, for example in permitting a much greater flexibility for the formulator in producing finished fuels, or concentrated additive blendstocks which are clean, highly biodegradable, have superior lubrication properties, and that can be pipelined or shipped as liquids under ambient or even arctic temperatures (e.g., −35° C. (−30° F.) or even lower).

The inventive fuels and processes permit independent optimization of the properties of fuel hydrocarbons and alcohol derivatives for overall superior results.

An especially important advantage is that the concentrated additives or "concentrates" of the invention separate much less readily from diluted blendstocks and/or finished fuels at low temperatures. This makes them highly desirable in a number of critical applications, including for use in jet fuel. Further, in preferred embodiments, the compositions are substantially olefin-free and $C_1$-$C_9$ carboxylate-free, thereby essentially eliminating peroxide forming tendencies and reducing corrosion/gum formation.

The present invention is accompanied by advantages useful not only to the manufacturers and consumers of fuels, but also to manufacturers and consumers of detergents, for example in that, by promoting the manufacture of selected alcohol derivatives for fuel uses, important economies of scale will make similar alcohol derivatives and/or sources of such derivatives (i.e., alcohols) much more affordable for detergent uses.

The present invention has numerous advantages. It allows transportation of concentrates as pumpable homogeneous liquids from a few purpose-built plants to supply worldwide clean jet/diesel fuel needs. Since certain process streams herein can also be used for detergents, the invention has the potential to make all manner of cleaning compositions, especially surfactants, using compounds from these streams more affordable for the consumer.

The new processes herein are simple and can use known process units, with a need only to connect or configure them in the novel ways taught herein. The processes thus require a minimum of additional new process development and are very practical. Unexpected process unit combinations herein include piggyback cracking (based on very old detergent art) on processes having modern hydrocracking/hydroisomerization (based on recent lubricant-making art, see for example S. J. Miller, Microporous Materials, Vol. 2 (1994), pp. 439-449.

The processes of the present invention utilize what are potentially the best and largest commercial sources of mid-chain methyl-branched paraffins worldwide, and flexibly accommodate the use of leading-edge technologies for making the main stream. There is little or no waste, since all byproducts from the side-stream(s) can be used or returned to the main stream of the fuel plant at a value equal or greater than on receipt.

Preferred embodiments of the process, which include FISCHER TROPSCH paraffin making in the main stream of the fuel plant, have an Oxo reaction, which can use substantially the same synthesis gas or $H_2$/CO ratio as the FISCHER TROPSCH paraffin making. The compositions produced have numerous advantages. The products of the present processes are unexpectedly superior for improving low temperature properties and fuel lubricity, permitting clean (low sulfur, low nitrogen) fuels yet having them be effective in the lubrication of fuel injectors and pumps. The nonlinear alcohol derivatives in the present compositions indeed have excellent surface properties at metal surfaces of components of internal combustion engines, especially in frictionally affected situations.

Most importantly, the specific long-chain branched primary Oxo alcohol derivatives produced herein have excellent low-temperature properties and significant lubricity-enhancing power for jet, diesel and turbine fuels. This is very important in view of various technological and environmental pressures to remove the inherent sulfur-based, nitrogen-based and aromatic based lubricity improvers from such fuels.

Moreover the present long-chain branched primary Oxo alcohol derivatives are especially useful for use in new, cleaner, small diesel engines being developed for use in automobiles. Thus, not only in its process embodiments, but also in its composition and method of use embodiments as described below, the present invention has high and significant value.

These and other aspects, features and advantages will be apparent from the following description and the appended claims. All parts, percentages and ratios used herein are expressed as percent weight unless otherwise specified. All documents cited are, in relevant part, incorporated herein by reference.

SUMMARY OF THE INVENTION

Figure 1A:
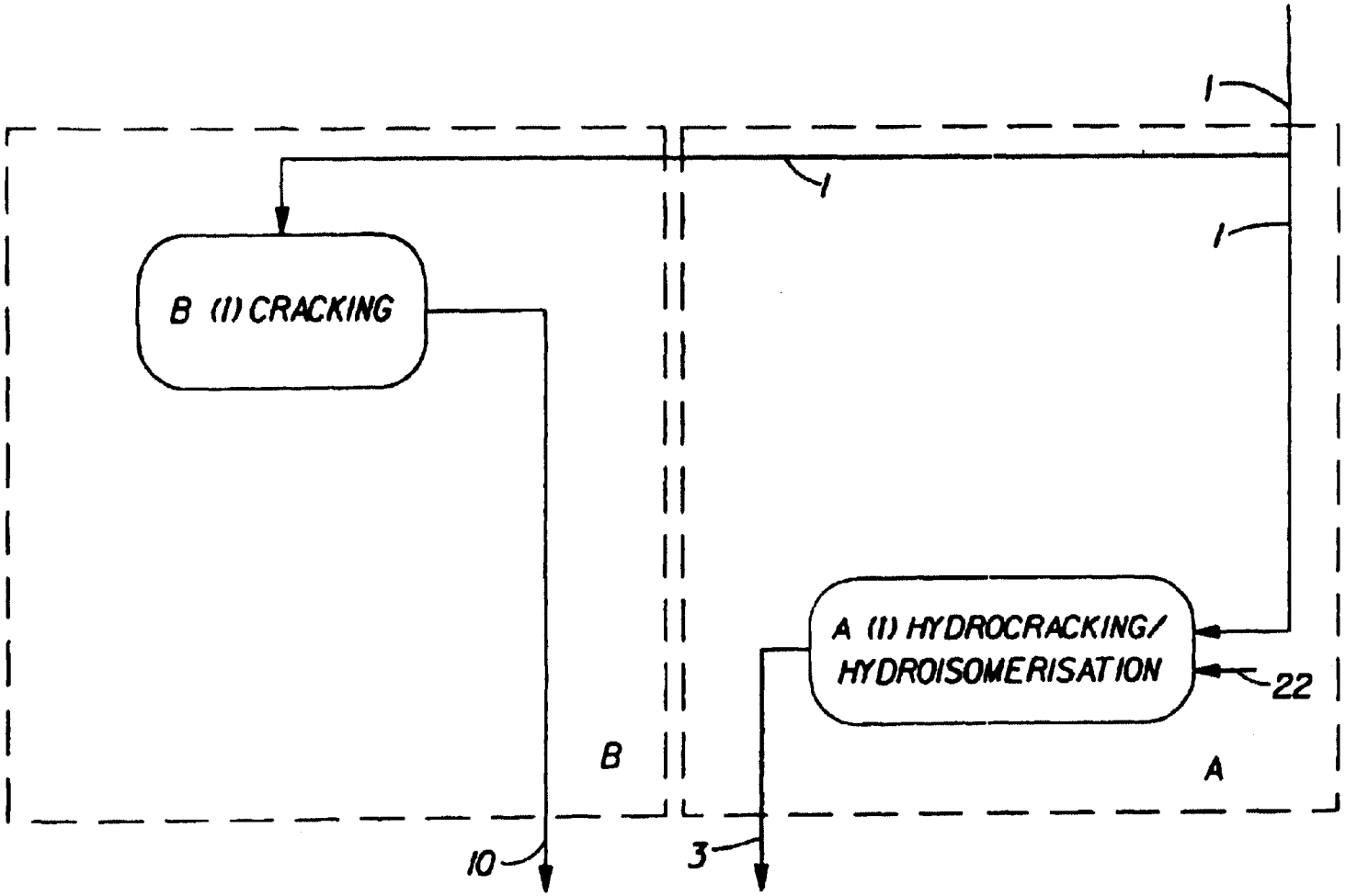
FIG. 1*a* is a flow diagram representing a process embodiment of the present invention having two process batteries preferably for use with petroleum wax.

The present invention relates to a fuel composition for internal combustion engines, said fuel composition comprising:

(a) at least about 5% of one or more fuel hydrocarbons and (b) at least about 10 ppm of one or more nonlinear primary aliphatic alcohol derivatives, wherein the alcohol moieties of said one or more alcohol derivatives have at least about 11 carbon atoms.

The present invention also relates to a fuel composition for internal combustion engines, said fuel composition comprising:

(c) at least about 5% of fuel hydrocarbons comprising:

(i) from about 1 ppm to about 10% of a first type of fuel hydrocarbons having from about 10 to about 20 carbon atoms selected from FISCHER-TROPSCH Oxo hydrocarbons;

(ii) from 0% to about 99% of a second type of fuel hydrocarbons selected from FISCHER-TROPSCH non-Oxo hydrocarbons; and (iii) from 0% to about 99% of at least one other type of fuel hydrocarbons, having at least about 5 carbon atoms other than (a) (i) and (a) (ii), provided that the sum of (a) (ii) and (a) (iii) is at least about 80% by weight of the fuel hydrocarbons;

(b) at least about 10 ppm of one or more nonlinear primary aliphatic alcohol derivatives, wherein the alcohol moieties of said one or more alcohol derivatives have at least about 11 carbon atoms wherein at least 0.6 weight fraction of the alcohol moieties of said one or more alcohol derivatives comprises at least one $C_1$-$C_3$ alkyl substituent situated on a third or higher carbon atom counting from the alcohol moiety hydroxy group; and not more than about 0.01 weight fraction of the alcohol moieties of said one or more alcohol derivatives comprise a quaternary substituted carbon atom; and (c) at least about 0.001 ppm of linear primary Oxo alcohol derivatives having at least 11 carbon atoms; and wherein said fuel has:

(i) a ratio by weight {(a)(ii)+(a)(iii)}:(a)(i) of at least about 10:1;

(ii) a ratio by weight (b):(c) of at least about 1:10, and (iii) from 0 ppm to no more than about 50 ppm of sulfur.

The present invention also relates to a fuel composition for use as jet or diesel fuel, the composition comprising the product of blending:

(a) from about 90% to about 99.9% of fuel hydrocarbons having from about 9 to about 20 carbon atoms; and (b) from about 100 ppm to about 10% of one or more nonlinear primary aliphatic alcohol derivatives, wherein said alcohol derivatives are the product of a process comprising:

(I) a first stage comprising: providing a member selected from (A) FISCHER-TROPSCH wax;

(B) conventional petroleum wax;

(C) a fuel hydrocarbon distillation cut in the Jet/diesel range, said distillation cut comprising at least about 0.8 weight fraction of linear paraffins, mono-, di- or tri-$C_1$-$C_3$ branched acyclic paraffins, or mixtures thereof; and (D) mixtures thereof; to form a first stage product;

(II) a pre-Oxo stage comprising sequentially or concurrently delinearizing and preparing the first stage product for Oxo reaction, said pre-Oxo stage comprising two or more steps to form a pre-Oxo stage product in any order selected from steps capable of effecting (i) chain-breaking, (ii) branch-forming and (iii) olefin-forming; and (III) an Oxo/post-Oxo stage comprising converting the pre-Oxo stage product to an Oxo alcohol, said Oxo/post-Oxo stage comprising at least one Oxo step and further optionally comprising an Oxo aldehyde to alcohol conversion step and optionally a step of hydrogenation of residual olefins to paraffins; and (IV) a derivatizing stage comprising derivatizing the Oxo alcohol to one or more. nonlinear primary aliphatic alcohol derivative.

The present invention further relates to a process for making a fuel composition, the process comprising a step of blending:

(a) from about 90% to about 99.9% of fuel hydrocarbons having from about 9 to about 20 carbon atoms; and (b) from about 100 ppm to about 10% of one or more nonlinear primary aliphatic alcohol derivatives, wherein said alcohol derivatives are produced by the following stages:

(I) a first stage comprising: providing a member selected from (A) FISCHER-TROPSCH wax;

(B) conventional petroleum wax;

(C) a fuel hydrocarbon distillation cut in the jet/diesel range, said distillation cut comprising at least about 0.8 weight fraction of linear paraffins, mono-, di- or tri-$C_1$-$C_3$ branched acyclic paraffins, or mixtures thereof; and (D) mixtures thereof to form a first stage product;

(II) a pre-Oxo stage comprising sequentially or concurrently delinearizing and preparing the first stage product for Oxo reaction, said pre-Oxo stage comprising two or more steps to form a pre-Oxo stage product in any order selected from steps capable of effecting (i) chain-breaking, (ii) branch-forming and (iii) olefin-forming, and (III) an Oxo/post-Oxo stage comprising converting the pre-Oxo stage product to an Oxo alcohol, said Oxo/post-Oxo stage comprising at least one Oxo step and further optionally comprising an Oxo aldehyde to alcohol conversion step and optionally a step of hydrogenation of residual olefins to paraffins; and a derivatizing stage comprising derivatizing the Oxo alcohol to one or more nonlinear primary aliphatic alcohol derivatives.

DETAILED DESCRIPTION OF THE INVENTION

The term "alcohol derivative" as used herein means materials that are derived from alcohols, particularly alcohol esters (i.e., alcohol formate, alcohol acetates, alcohol butyrates, alcohol isobutyrates, alcohol glycolates, alcohol lactates), alcohol alkoxylates (i.e., alcohol ethoxylates, alcohol propoxylates, alcohol mixed ethoxylates/propoxylates), alcohol glycerin ethers, alcohol acid esters (i.e., monomaleate, monosuccinate, monophthalate).

The term "short chain" as used in conjunction with the alcohols, alcohol derivatives and/or the alcohol moieties of the derivatives, refers to alcohols, alcohol derivatives and/or the alcohol moieties of the derivatives having a carbon content of from one carbon atom to about 10 carbon atoms, to alcohol derivative mixtures in which such alcohol derivatives predominate, or to branched alcohol derivatives in which the longest possible linear chain alcohol moiety of the derivatives has no more than about 9 carbon atoms, such as 2-ethylhexanol or 2-propylheptanol. "Short chain" alcohol derivatives typically encompass alcohol moieties obtained from plasticizer alcohols, but not alcohol moieties of types commonly known as detergent alcohols.

The term "long chain" as used in conjunction with the alcohols, alcohol derivatives and/or the alcohol moieties of the derivatives, refers to alcohols, alcohol derivatives and/or the alcohol moieties of the derivatives having a carbon content of from about 11 carbon atoms to about 21 carbon atoms, though in general when a distribution of chain lengths is present, a minor proportion in the tails of the distribution may lie outside this range and, when there is branching, more than 20 carbon atoms may in general be present. The term "long chain" can appropriately be applied to the alcohols, alcohol derivatives and/or the alcohol moieties of the derivatives herein.

Alcohol derivatives in the art can have a very large variety of structures and include natural and synthetic types, linear-, branched- or cyclic-aliphatic monoalcohol derivatives, diol derivatives and/or polyol derivatives; and aromatic or heterocyclic alcohol derivatives including natural alcohol derivatives, e.g., sugars and/or heteroatom-functional aliphatic alcohol derivatives such as aminoalcohol derivatives. In general, alcohol derivatives can be saturated or unsaturated, linear or have branches of a great variety of types known in the art depending on the size and position of branching moieties or, in other terms, analytical characterization (e.g., by NMR), performance properties, or the process by which the alcohol derivatives are made.

As is the case with alcohol derivatives, hydrocarbons are known with an enormous variety of structures and substitution patterns. Hydrocarbons include crude oil and lubricating oils. The term "fuel" as used herein, for example in the phrases "fuel blend stock" or "finished fuel composition" or "fuel hydrocarbon" is a much more specific term than (unqualified) "hydrocarbon", and refers to a hydrocarbonaceous fluid suitable for combustion in turbine or nonturbine engines including internal or surface combustion engines, the internal combustion type in particular including jet and diesel engines.

Properties qualifying or permitting selection of hydrocarbons as fuel are extensively documented in the technical literature, see for example Kirk Othmer's Encyclopedia of Chemical Technology, 4th Edition, Wiley, N.Y., Volume 3, 1992, pp. 788-812 and Kirk Othmer's Encyclopedia of Chemical Technology, 4th Edition, Wiley, N.Y., Volume 12, 1994, pp. 373-388, and some of these properties are also easily appreciated by the non-technical person.

The fuel compositions of the present invention include compositions of types termed "concentrates", as well as compositions of types termed "blendstocks" and types termed "finished fuels". "Concentrates" or "concentrated additives" herein can include derivatives of the nonlinear Oxo alcohol-rich mixtures (which may include some free alcohol) with variable levels of FISCHER-TROPSCH Oxo hydrocarbons, and derivatives of the nonlinear Oxo alcohol-rich mixtures (which may include some free alcohol) having non-Oxo fuel hydrocarbons beyond the aforementioned hydrocarbon component. A "concentrate" or "concentrated additive" as defined herein is a precursor to a finished fuel composition or blendstock composition, and can be used for a number of purposes. For example, the concentrate can be stored as a liquid, even under extreme low temperatures, and can be pumped or transported to other refineries desiring the lubricity advantages of the alcohol derivatives in the concentrate, all without the transportation costs of a large amount of hydrocarbon. Optionally, the alcohol, prior to derivatization, with further distillation, can serve as an important high concentration source of very desirable alcohols for detergent manufacturers. It would be obvious to one of ordinary skill in the art that a detergent alcohol and/or detergent alcohol derivative (especially ethoxylates) can be readily isolated from the process of the present invention suitable for detergent use. Moreover, the concentrate can be used in the plant as an alcohol derivative-rich stream for further blending and dilution into lubricious low-sulfur fuels. A concentrate as defined herein is a composition suitable for converting to a fuel blendstock or to a finished fuel composition by blending with additional components.

The fuel compositions herein also include types termed "blendstocks". These differ from "concentrates" in that, in the blendstocks, desired nonlinear alcohol derivatives, as are present in the above concentrates, are blended with certain hydrocarbons, thereby achieving full independence in the co-adjusting of fuel lubricity and a second parameter of the fuel selected from fuel smoke point and fuel cetane number. This independence includes both upward and downward adjustability of this second parameter. Preferred "blendstocks" as defined herein comprise at least two fuel hydrocarbon types, specifically including both an FISCHER-TROPSCH Oxo type and at least one FISCHER-TROPSCH non-Oxo type, wherein the latter is the majority of the total fuel hydrocarbon.

Blendstocks may be especially useful in that they may use the whole FISCHER-TROPSCH plant output, into which a significant level of alcohol derivative is blended. Upon shipment to conventional refineries, finished fuel may be made by blending from about 5% to about 25% of this blendstock and the balance conventional refined low-sulfur fuel. Prior to this final blending, the blendstock could be pipelined batchwise, alternating with batches of other petroleum products or crude. For example, Trans Mountain Pipeline Co. Ltd., Vancouver, successfully transports various refined products and crude in batches by a common pipeline over the Canadian Rockies, at least 1100 kilometers from Edmonton to Vancouver. See Oil & Gas Journal, Vol. 96, No. 40, Oct. 5, 1998, pp. 49-55.

The fuel compositions herein also include types termed "finished fuels". The finished fuels differ from "concentrates" and "blendstocks" in that they comprise only alcohol derivatives at low levels (e.g., from about 10 ppm to about 1%), and provide desired attributes for such finished fuels such as lubricity, preventing corrosion, surfactancy, smoke and particulate matter mitigation, and any other attributes discussed herein. The levels of an alcohol derivative in blendstocks and concentrates are typically much higher than in finished fuels, in general the levels varying widely but remaining consistent with the intended use in the blendstocks and concentrates. For economic reasons, "finished fuels" herein include, when desired, diluting amounts of refined petroleum hydrocarbons. These differ from FISCHER-TROPSCH hydrocarbons and, particularly, typically include a significant level of cyclic hydrocarbons, though upper limits on desirable levels of certain cyclics are prescribed hereinafter.

Alcohol Derivatives

The alcohol derivatives of the present invention may be a mixture of alcohol derivative compounds having a particularly selected structure as described further hereinafter. A specific alcohol derivative itself is further to be distinguished from process streams containing the alcohols from which it is derived, for example stream 13 in FIGS. 2, and 3, stream 14 in FIG. 4, stream 13 in FIGS. 5 and 6. These streams are a mixture of the alcohol derivatives and/or alcohols from which the alcohol derivatives are derived and/or FISCHER-TROPSCH Oxo hydrocarbons being essentially in paraffinic form, not counting any impurities. In more detail, the non-hydroxy moieties of the alcohol derivative, commonly referred to as the hydrocarbyl moieties, have a specific type of permissible branching conveyed herein by the term "nonlinear". Desirable alcohol derivatives herein can be saturated and substantially acyclic, having no more than about 1%, preferably less than 0.01% cyclic aliphatic alcohols as impurity. The term "nonlinear" excludes "exclusively linear" and "substantially linear" and is moreover intended to be construed strictly (see for example the structural formulas hereinafter) with respect to the type of departure from linearity. Thus alcohol derivatives obtained from current commercial EXXAL® alcohols, comprising appreciable quaternary carbon content are, for example, unsuitable as alcohol derivatives herein. Likewise, alcohol derivatives obtained from other alcohols, which are discussed in more detail below that include varied branched types, such as Guerbet types, as well as known linear types, e.g., Ziegler or the substantially linear NEODOL® alcohols, are unsuitable as alcohol derivatives of the present invention.

The alcohol moiety of the alcohol derivatives of the present invention generally comprise at least about 0.3 weight fraction, preferably at least about 0.6 weight fraction, more preferably at least about 0.8 to about 1.0 weight fraction of nonlinear long chain saturated primary aliphatic alcohol derivatives. The balance of the alcohol derivative component can be any other alcohol derivatives, for example linear alcohol derivatives, and especially those alcohol derivatives consistent with the manner in which the alcohol derivatives of the present invention are made. Alcohol derivatives of the present invention can include linear Oxo alcohol derivatives, dihydric alcohol derivatives, polyhydric alcohol derivatives, unsaturated alcohol derivatives, cyclic alcohol derivatives, and the like in varying proportions, always provided that the necessary minimum amount of specific nonlinear alcohol derivatives is present.

In preferred compositions herein, alcohol derivatives can be specific nonlinear primary aliphatic Oxo alcohol derivatives. At least 60% of the nonlinear primary aliphatic Oxo alcohol derivatives comprise at least one $C_1$-$C_3$ alkyl branch on a third or higher carbon atom counting from an Oxo alcohol derivative hydroxy group.

In one important group of preferred compositions herein, alcohol derivatives of the present invention can be derived from monohydric alcohols.

However, in another group of preferred compositions, alcohol derivatives of the present invention can be derived from nonlinear diols or monohydric alcohol/dihydric alcohol mixtures. These nonlinear diols, further illustrated hereinafter, have a dihydric component having structures that have certain features in common with the monohydric type. However, compositions encompassed herein also include those wherein said nonlinear primary aliphatic Oxo alcohol derivatives can be substantially free from diol derivatives.

In functional terms, the nonlinear primary aliphatic Oxo alcohol derivatives of the present invention represent alcohol derivatives which are selected for biodegradability and at the same time lubricating, pour-point depressing properties as further defined hereinafter. Thus the biodegradability is close or equal to the biodegradability of linear or substantially linear long-chain alcohol derivatives, and the lubricating, pour-point depressing properties are at the same time greatly superior.

The present invention includes fuel compositions wherein the nonlinear primary aliphatic Oxo alcohol derivatives are selected from lubricating, pour-point depressing nonlinear primary aliphatic Oxo alcohol derivatives. By "lubricating" is meant that the nonlinear alcohol derivative is capable of delivering lubrication as measured, for example, by the BOCLE or HFRR tests, when incorporated into a jet or diesel fuel, to at least the same degree on a mass basis as a linear alcohol of the general type disclosed in U.S. Pat. No. 5,766,274 (jet) or U.S. Pat. No. 5,814,109 (diesel). By "pour point depressing" is qualitatively meant that the nonlinear primary aliphatic Oxo alcohol derivative has a pour point at least about 10° C. below the pour point of a linear primary alcohol derivative having about the same carbon number. The present invention therefore also includes fuel compositions wherein the nonlinear primary aliphatic Oxo alcohol derivatives having lubricating and pour-point depressing properties are present in component (b) in a weight fraction sufficient to depress the additive pour point, $APP_l$, of component (b) to at least 10° C., preferably at least 50° C., below the additive pour point $APP_R$, of a reference alcohol derivative composition consisting essentially of the corresponding linear primary aliphatic alcohol derivatives. For example, with respect to alcohols themselves, a reference alcohol suitable for derivatization in accordance with the present invention consisting essentially of 1-octadecanol melts (or has an additive pour point $APP_R$,) of about +60° C. In contrast, a sample of $C_{18}$ nonlinear alcohol has an additive pour point ($APP_l$) of below −30° C. Thus, with reference to the above definition, the nonlinear primary aliphatic Oxo alcohol when used in the invention in place of 1-octadecanol will produce a depression of at least about 90° C., a dramatically superior result. In practice, mixtures of two or more nonlinear primary aliphatic Oxo alcohol derivatives are more typically used herein, with even better results. The alcohol primary aliphatic Oxo derivatives can also have low pour points, as evidenced by a 50/50 mixed $C_{16/17}$ acetate ester alcohol derivative has a pour point of about −48° C., and a 50/50 mixed $C_{16/17}$ ethoxylate (1.5 average) alcohol derivative has a pour point of about −34° C.

In addition to some limited proportion of unsaturated alcohols, cyclic alcohols and/or cyclic alcohol derivatives, etc., in commercial grade nonlinear primary aliphatic Oxo alcohol derivative compositions, the present compositions may further comprise a conventional linear Oxo alcohols and/or conventional linear Oxo alcohol derivatives, but not as the sole essential alcohol derivative component. Such compositions include the product of blending base stock fuel and members of nonlinear alcohols and nonlinear alcohol derivatives synthesized nonintegrally with components of said base stock fuel, thereby achieving higher ratios of at least 10:1 of the nonlinear alcohol moiety of the nonlinear alcohol and/or its derivative to linear Oxo alcohols than can be attained by known FISCHER-TROPSCH wax processes for making oxygenated fuels.

In more highly preferred compositions herein, the nonlinear alcohols and/or nonlinear alcohols derivatives are substantially free from methyl butanols and/or methyl butanols derivatives, ethylhexanols and/or ethylhexanols derivatives, propylheptanols and/or propylheptanols derivatives, natural alcohols and/or natural alcohols derivative mixtures, aminoalcohols and/or aminoalcohols derivatives, aromatic alcohols and/or aromatic alcohols derivatives, glycols and/or glycols derivatives having linear hydrocarbon chains, alcohols and/or alcohols derivatives comprising the aldol condensation product of aldehydes, and alcohols and/or alcohols derivatives comprising quaternized carbon and consisting of the Oxo product of acid-catalyzed propylene/butylene oligomerization.

Nonlinear Alcohol Derivative Structures

The invention also encompasses fuel compositions wherein the nonlinear alcohol derivatives, more particularly nonlinear primary aliphatic alcohol derivatives, especially Oxo alcohol derivatives, have the formula:

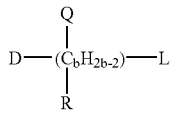

wherein $C_bH_2H_{2b-2}$ is a linear saturated hydrocarbyl; b is an integer selected such that the total carbon content (range in number of carbon atoms) of the alcohol moiety of said nonlinear primary aliphatic Oxo alcohol derivative is from about 11 to about 21 carbon atoms; and D, L, Q and R are substituents; with D and L preferably being terminally located on said linear saturated hydrocarbyl; D is $CH_3$, L is the moiety:

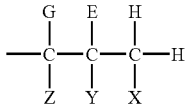

wherein one of X and Y and Z is independently selected from the group consisting of 1) $CH_2OC(O)R'$ wherein R' is selected from H, $CH_3$, $CH_2CH_3$, $CH_2CH_2CH_3$, $CH_2OH$, $CHOHCH_3$, CH═CHC(O)OH, $CH_2CH_2C(O)OH$, $C_6H_5C(O)OH$ (those of ordinary skill in the art will appreciate that diesters of these anhydride compounds can occur, which are also included within the scope of the present invention);

2) $CH_2O(alkoxy)_nH$; n represents that average of alkoxy units and has a value of from about 0.01 to about 5, preferably from about 0.1 to about 4;

3) $CH_2OCH_2CH(OH)CH_2OH$;

4) $CH_2OCH_2CH(OH)CH_2OCH_2CH(OH)CH_2OH$;

5) $CH_2OCH_2CH_2C(O)OH$; and 6) mixtures thereof;

preferably one of X and Y is independently selected from the group consisting of $CH_2OC(O)R'$ wherein R' and n are defined as above; $CH_2O(alkoxy)_nH$; $CH_2OCH_2CH(OH)CH_2OH$; $CH_2OCH_2CH(OH)CH_2OCH_2CH(OH)CH_2OH$; $CH_2OCH_2CH_2C(O)OH$ and mixtures thereof; more preferably X is independently selected from the group consisting of $CH_2OC(O)R'$ wherein R' and n are defined as above; $CH_2O(alkoxy)_nH$; $CH_2OCH_2CH(OH)CH_2OH$; $CH_2OCH_2CH(OH)CH_2OCH_2CH(OH)CH_2OH$; $CH_2OCH_2CH_2C(O)OH$ and mixtures thereof; any of X and Y and Z which is not independently selected from the group consisting of $CH_2OC(O)R'$ wherein R' and n are defined as above; $CH_2O(alkoxy)_nH$; $CH_2OCH_2CH(OH)CH_2OH$; $CH_2OCH_2CH(OH)CH_2OCH_2CH(OH)CH_2OH$; $CH_2OCH_2CH_2C(O)OH$ and mixtures thereof, is H. E, G and Q are selected from H, methyl, ethyl, propyl and butyl, provided that at least one of E, G and Q is not H, more preferably at least one of G and Q is not H; more preferably still Q is methyl and E and G are H; R is selected from H, methyl ethyl, propyl and butyl, preferably R is H. In preferred alcohol derivatives of the above formula, when Q and R are both different from H, Q and R are attached to different carbon atoms of said linear saturated hydrocarbyl. Preferably no carbons are quaternary, for example, E and Y are not simultaneously carbon-containing. In preferred examples of such nonlinear primary aliphatic derivatives, Q and R are both different from H, and Q and R are attached to different carbon atoms of said linear saturated hydrocarbyl.

Note that in the structural formulas throughout the specification, —H is always hydrogen.

Also encompassed herein are fuel compositions wherein said nonlinear primary aliphatic alcohol derivatives, preferably Oxo alcohol derivatives, have the formula:

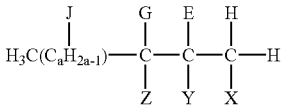

wherein one of X and Y and Z is independently selected from the group consisting of:

1) $CH_2OC(O)R'$ wherein R' is selected from H, $CH_3$, $CH_2CH_3$, $CH_2CH_2CH_3$, $CH_2OH$, $CHOHCH_3$, CH═CHC(O)OH, $CH_2CH_2C(O)OH$, $C_6H_5C(O)OH$ (those of ordinary skill in the art will appreciate that diesters of these compounds can occur, which are also included within the scope of the present invention);

2) $CH_2O(alkoxy)_nH$, n represents that average of alkoxy units and has a value of from about 0.01 to about 5, preferably from about 0.1 to about 4;

3) $CH_2OCH_2CH(OH)CH_2OH$;

4) $CH_2OCH_2CH(OH)CH_2OCH_2CH(OH)CH_2OH$;

5) $CH_2OCH_2CH_2C(O)OH$; and 6) mixtures thereof;

preferably one of X and Y is independently selected from the group consisting of $CH_2OC(O)R'$ wherein R' and n are defined as above; $CH_2O(alkoxy)_nH$; $CH_2OCH_2CH(OH)CH_2OH$; $CH_2OCH_2CH(OH)CH_2OCH_2CH(OH)CH_2OH$; $CH_2OCH_2CH_2C(O)OH$ and mixtures thereof; more preferably X is independently selected from the group consisting of $CH_2OC(O)R'$ wherein R' and n are defined as above; $CH_2O(alkoxy)_nH$; $CH_2OCH_2CH(OH)CH_2OH$; $CH_2OCH_2CH(OH)CH_2OCH_2CH(OH)CH_2OH$; $CH_2OCH_2CH_2C(O)OH$ and mixtures thereof any of X and Y and Z which is not independently selected from the group consisting of $CH_2OC(O)R'$ wherein R' and n are defined as above; $CH_2O(alkoxy)_nH$; $CH_2OCH_2CH(OH)CH_2OH$; $CH_2OCH_2CH(OH)CH_2OCH_2CH(OH)CH_2OH$; $CH_2OCH_2CH_2C(O)OH$ and mixtures thereof, is H. E, G and J are selected from H and methyl provided that at least one of E, G and J is methyl, more preferably at least one of G and J is methyl; more preferably still J is methyl and E and G are H; the moiety $C_aH_{2a-1}$ is a linear saturated hydrocarbyl; preferably no carbon atoms are quaternary for example, the pair of substituents E and Y are not simultaneously carbon-containing and the pair of substituents G and Z are not simultaneously carbon-containing; and a is an integer selected such that the total carbon content of the alcohol moiety of said alcohol derivative is from about 11 to about 21.

Suitable nonlinear alcohol derivatives of the present invention are further nonlimitingly illustrated by:

(I) nonlinear alcohol derivatives of nonlinear alcohols disclosed in commonly assigned patent publications WO 97/38956, WO 97/38957, WO 9738972, WO 97/39087, WO 97/39088, WO 97/39089, WO 97/39090, WO 97/39091, especially those long-chain alcohols identified therein as mid-chain branched or lightly branched alcohols;

(II) nonlinear alcohol derivatives of nonlinear alcohols disclosed in WO 98/23566 and U.S. Pat. No. 5,849,960 assigned to Shell. As characterized spectroscopically, these particular alcohols assertedly have both methyl and ethyl branches;

(III) nonlinear alcohol derivatives of nonlinear alcohols disclosed in U.S. Pat. No. 5,780,694 assigned to Shell. These alcohols are obtained by dimerizing an olefin feed comprising $C_6$-$C_{10}$ linear olefins to obtain certain $C_{12}$-$C_{20}$ olefins which are converted to specific Oxo alcohol derivatives by hydroformylation;

(IV) nonlinear alcohol derivatives of nonlinear alcohols disclosed in AU 8939394 A assigned to Shell. These alcohol derivatives are obtained from certain hydroformylated, ethylated olefins;

(V) nonlinear alcohol derivatives of nonlinear alcohols disclosed in WO 97/01521, Sasol which discloses a process for producing FISCHER-TROPSCH alcohols from Sasol's FISCHER-TROPSCH, e.g., Synthol, olefin/paraffin mixtures. These can be of widely varying chainlength, and include some nonlinear long chain saturated primary aliphatic alcohols that are suitably long-chained;

(VI) nonlinear alcohol derivatives of nonlinear alcohols disclosed in U.S. Pat. No. H 0001818, Sasol which discloses detergent alcohols made from their olefins, and use thereof for making detergents. The alcohols include some nonlinear saturated primary aliphatic alcohols ($C_9$-$C_{15}$) that include long-chain (e.g, $C_{11}$ or higher) nonlinear saturated primary aliphatic alcohols. The alcohols disclosed comprise mixtures of linear and methyl branched species;

(VII) much less desirably, nonlinear alcohol derivatives of nonlinear alcohols known as LIAL® alcohols available from Enichem. LIAL® alcohols are defined herein as "alcohols comprising the Oxo product of linear internal olefins".

Note that in general the above-referenced alcohol derivatives and/or alcohols can be interchanged for purposes of the present fuel compositions, which comprise fuel hydrocarbons, so long as at least one alcohol derivative is present in the composition. Otherwise, they should be regarded as separately and distinct materials in the art and are not interchangeable in general, for example in detergents.

Preferred nonlinear alcohol derivatives in (I)-(VII) include nonlinear alcohol derivatives from (I), (II), (V), (VI), and any mixtures thereof.

Particularly preferred nonlinear alcohol derivatives in (I)-(VII) include nonlinear alcohol derivatives from (I), (II), and mixtures thereof in all or any proportions.

Examples of preferred nonlinear alcohol derivatives include the following general formulas:

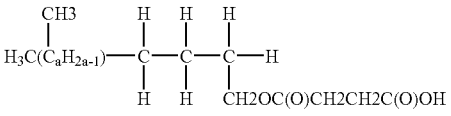

wherein the carbonyl is in the ortho-, meta-, or para-position, preferably in the ortho-position.

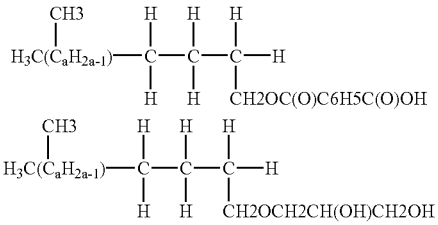

-continued

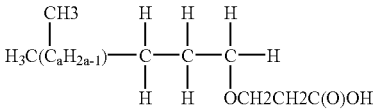

wherein a for all of the above formulas is an integer selected such that the total carbon content of the alcohol moiety of alcohol derivative is from about 11 to about 21. To the extent that any of the above-identified nonlinear alcohol derivatives are novel, the present invention also encompasses the above identified nonlinear alcohol derivatives per se.

Fuel Hydrocarbon

The fuel hydrocarbon herein in general typically comprises at least one fuel hydrocarbon selected such that, in combination with the above-identified nonlinear primary aliphatic alcohol derivative, a fuel results which will burn cleanly and will be lubricious. In general, the fuel hydrocarbon can vary quite broadly. However, in all the preferred compositions, at least one fuel hydrocarbon is present which is defined as a FISCHER-TROPSCH Oxo hydrocarbon, that is a fuel hydrocarbon derived from passage through the stages of a process having both a FISCHER-TROPSCH stage and at least one Oxo reaction stage (the latter primarily directed for making alcohol derivative).

The preferred compositions herein comprise fuel hydrocarbons in one of the following variations:

- both an FISCHER-TROPSCH Oxo hydrocarbon and at least one FISCHER-TROPSCH non Oxo hydrocarbon;
- both an FISCHER-TROPSCH Oxo hydrocarbon and at least one non-F.T, non-Oxo hydrocarbon; and
- all three of an FISCHER-TROPSCH Oxo hydrocarbon, an FISCHER-TROPSCH non-Oxo hydrocarbon, and a non-FISCHER-TROPSCH, non Oxo hydrocarbon.

In general any of the above hydrocarbons can vary in degree of hydrogenation and olefinic, paraffinic and olefinic/paraffinic variants are encompassed especially in terms of process streams. However, preferably in the composition embodiments and in preferred output streams of the processes herein, the FISCHER-TROPSCH Oxo hydrocarbons and FISCHER-TROPSCH non-Oxo hydrocarbons are substantially fully hydrogenated. By the phrase "substantially fully hydrogenated" it is meant that other than impurities which are counted separately in the compositions, these fuel hydrocarbons are paraffins. The non-FISCHER-TROPSCH, non-Oxo hydrocarbon can vary more widely in both the composition and process embodiments, but embodiments are included in which the non-FISCHER-TROPSCH, non-Oxo hydrocarbon, as in the case of the other types, is largely paraffins, maphthenes and some aromatics.

In more detail, the differences between the different types of fuel hydrocarbons in the present compositions can be exemplified or illustrated as in the following Tables 1-4. A "reference hydrocarbon" is introduced first since such a hydrocarbon is one that is relatable to the above-identified and fully disclosed nonlinear primary aliphatic alcohol derivative simply in that the reference hydrocarbon is it's the disclosed nonlinear primary aliphatic alcohol derivative's hydrogenolysis product. See for example R. G. Brownlee and R. M. Silverstein, Anal. Chem., Vol. 40 (13), pp. 2077-9, (1968) or M. Beroza and R. Sarmiento, Anal. Chem., Vol. 37, p. 1042 (1965) for suitable microhydrogenolysis methods. Then the other types of fuel hydrocarbon are readily compared to the reference hydrocarbon. Note also that the nonlinear alcohol derivatives herein can be separated from fuel hydrocarbons by any known techniques, for example silica gel adsorption chromatography (HPLC).

TABLE 1

| | RH |
|---|---|
| Hydrocarbon: | Reference Hydrocarbon (analytical standard) hydrocarbon corresponding exactly to the nonlinear alcohol moiety of the alcohol derivative minus OH and/or derivative group(s) |
| Process/Source: | derivable from nonlinear primary aliphatic alcohol derivative by specified procedure, microhydrogenolysis (see Anal. Chem., Vol 40 (13), pp. 2077-9 (above) or Anal. Chem. Vol. 37, p. 1042 (above)). |
| linearity or branching | type and degree of branching identical to nonlinear primary aliphatic alcohol derivative; no quaternary carbons |
| carbon range and distribution | narrow carbon distribution per G.C; two-carbon or four-carbon range, preferably including at least one carbon number in range 14-17; preferably range never goes down to 11 |
| cyclics (cycloaliphatic) | <5%, often <1% |
| aromatics | ≦1% |

TABLE 2

| | fuel hydrocarbon (a)(i) |
|---|---|
| Hydrocarbon: | FISCHER-TROPSCH Oxo hydrocarbon |
| Process/Source: | derived by FISCHER-TROPSCH and formed and/or passed through an Oxo reactor |
| linearity or branching | less branching than nonlinear alcohol; no quaternary carbons |
| carbon range and distribution | narrow carbon distribution per G.C; two-carbon or four-carbon range, preferably including at least one carbon number in range 13-16; preferably range never goes down to 10. |
| Cyclics (cycloaliphatic) | <5%, often <1% |
| aromatics | ≦1% |

TABLE 3

| | fuel hydrocarbon (a)(ii) |
|---|---|
| Hydrocarbon: | FISCHER-TROPSCH non-Oxo hydrocarbon |
| Process/Source: | derived by FISCHER-TROPSCH and not formed in or passed through an Oxo reactor |
| linearity or branching | less branching than RH and nonlinear alcohol; no quaternary carbons |
| carbon range and distribution | broader carbon distribution per G.C than RH; distribution typical of current commercial jet and/or diesel fuel hydrocarbons |
| cyclics (cycloaliphatic) | <5%, often <1% |
| aromatics | ≦1% |

TABLE 4

| | fuel hydrocarbon (a)(iii) |
|---|---|
| Hydrocarbon: | Fuel hydrocarbon other than (a)(i) or (a)(ii) |
| Process/Source: | derived from refining of petroleum; not derived by FISCHER-TROPSCH and not formed in or passed through an Oxo reactor |
| linearity or branching | more branching than RH; often includes quaternary carbons |
| carbon range and distribution | broader carbon distribution per G.C than RH; distribution typical of current commercial jet and/or diesel fuel hydrocarbons |
| cyclics (cycloaliphatic) | ≧10% |
| aromatics | usually >5% |

For compositions of the invention to be used as diesel fuel, the fuel hydrocarbon component herein can, for example, be generally one meeting the specification illustrated in "Swedish city diesel class one", see "The Chemical Engineer", Issue 632, April 1997, pages 28-32; or as exemplified in U.S. Pat. No. 5,689,031, see Col. 4, but differing in the presence of both FISCHER-TROPSCH Oxo and FISCHER-TROPSCH non Oxo hydrocarbons.

For compositions of the invention to be used as jet fuel, the fuel hydrocarbon component herein can, for example, be generally one meeting the specification illustrated in U.S. Pat. No. 5,766,274, see Col. 2, but differing in the presence of both FISCHER-TROPSCH Oxo and FISCHER-TROPSCH non-Oxo hydrocarbons.

In practice the fuel hydrocarbon herein must not only meet specifications such as those referenced above, but also must have particular compositions as described in greater detail, for example in the section identified as "Compositions" hereinafter.

The terms "cut", "two-carbon cut" and "four carbon cut" may be used herein in referring to fuel hydrocarbons, Oxo alcohols (from which the Oxo alcohol derivatives are subsequently) made or process streams. A "cut" is a practically obtainable distillation fraction of fuel hydrocarbons or of alcohols. For example, an "olefin/paraffin" cut is a mixture of olefins and paraffins obtainable as a mixture when distilling in a particular temperature range. A "jet/diesel cut" is a mixture of fuel hydrocarbons having boiling temperatures in a range consistent with jet and diesel fuels. A "two carbon cut" (e.g., a $C_{14}$-$C_{15}$ cut) is a distillation fraction containing all the compounds having a first specified total number of carbon atoms (i.e., 14) and all the compounds having a second specified total number of carbon atoms (i.e., 15). A "four carbon cut", e.g., a $C_{14}$-$C_{17}$ cut, is a distillation fraction having a first specified total number of carbon atoms (i.e., 14) and all the compounds in the range (i.e., at $C_{15}$ or $C_{16}$ or $C_{17}$) up to a second specified (i.e., 17) total number of carbon atoms. Very usefully, it is observed that a two-carbon cut of nonlinear alcohols from which the derivatives are subsequently made in a preferred range of carbon number can be separated by distillation, e.g., stream 14 in FIG. 3, unit B(v), from other components, e.g., diols, stream 19 and hydrocarbons, stream 15.

Diol Derivatives

The present invention can also make use of certain diols and/or diol derivatives, specifically diols and/or diol derivatives, which possess certain commonalities in structure with the above-identified nonlinear primary aliphatic alcohol derivatives and/or the non-derivatized nonlinear alcohol source. Diols and/or diol derivatives herein are not however counted as part of the nonlinear primary aliphatic alcohol derivative component, as described above, but can be optionally contained in the fuel compositions of the present invention. Thus also encompassed herein are fuel compositions comprising nonlinear diol derivatives of the formula:

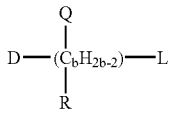

wherein $C_bH_{2b-2}$ is a linear saturated hydrocarbyl; b is an integer selected such that the total carbon content of nonlinear diol moiety of said nonlinear diol derivative is from about 12 to about 22; and D, L, Q and R are substituents; D and L are independently selected from:

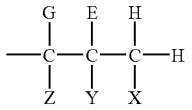

wherein one of X and Y and Z is independently selected from the group consisting of:

1) $CH_2OC(O)R'$ wherein R' is selected from H, $CH_3$, $CH_2CH_3$, $CH_2CH_2CH_3$, $CH_{CHOHCH3}$, CH=CHC(O)OH, $CH_2CH_2C(O)OH$, $C_6H_5C(O)OH$ (those of ordinary skill in the art will appreciate that diesters of these compounds can occur, which are also included within the scope of the present invention);

2) $CH_2O(alkoxy)_nH$, n represents that average of alkoxy units and has a value of from about 0.01 to about 5, preferably from about 0.1 to about 4;

3) $CH_2OCH_2CH(OH)CH_2OH$;

4) $CH_2OCH_2CH(OH)CH_2OCH_2CH(OH)CH_2OH$;

5) $CH_2OCH_2CH_2C(O)OH$; and 6) mixtures thereof;

preferably one of X and Y is independently selected from the group consisting of $CH_2OC(O)R'$ wherein R' and n are defined as above; $CH_2O(alkoxy)_nH$; $CH_2OCH_2CH(OH)CH_2OH$; $CH_2OCH_2CH(OH)CH_2OCH_2CH(OH)CH_2OH$; $CH_2OCH_2CH_2C(O)OH$ and mixtures thereof; more preferably X is independently selected from the group consisting of $CH_2OC(O)R'$ wherein R' and n are defined as above; $CH_2O(alkoxy)_nH$; $CH_2OCH_2CH(OH)CH_2OH$; $CH_2OCH_2CH(OH)CH_2OCH_2CH(OH)CH_2OH$; $CH_2OCH_2CH_2C(O)OH$ and mixtures thereof; any of X and Y and Z which is not independently selected from the group consisting of $CH_2OC(O)R'$ wherein R' and n are defined as above; $CH_2O(alkoxy)_nH$; $CH_2OCH_2CH(OH)CH_2OH$; $CH_2OCH_2CH(OH)CH_2OCH_2CH(OH)CH_2OH$; $CH_2OCH_2CH_2C(O)OH$ and mixtures thereof, is H. E, G and Q are selected from H, methyl, ethyl, propyl and butyl provided that at least one of E, G and Q is not H, more preferably at least one of G and Q is not H; more preferably still Q is methyl and E and G are H; and R is selected from H, methyl, ethyl, propyl and butyl, preferably R is H. In preferred fuel compositions comprising nonlinear diol derivatives, said nonlinear diol derivatives are nonlinear Oxo diol derivatives, and wherein when Q and R are both different from H, Q and R are attached to different carbon atoms of said linear saturated hydrocarbyl. Preferably, no carbons are quaternary, i.e., for example, E and Y are not simultaneously carbon-containing.

When nonlinear diol derivatives are present in the compositions of the invention, the nonlinear primary aliphatic alcohol derivatives (b) that are present in all the preferred embodiments of the present invention, and said nonlinear diol derivatives, (d), are present in the compositions at a ratio (b):(d), of from about 1000:1 to about 2:1 by weight. Nonlinear diol derivatives when present in the compositions of the invention are generally at a level of from about 0.001 ppm to about 30% by weight of the fuel composition. To the extent that the above-identified nonlinear diol derivatives are novel, the invention also encompasses the above-identified nonlinear diol derivatives per-se.

Other Alcohols/Alcohol Derivatives

In general, other than the above-identified nonlinear primary aliphatic alcohol derivatives, alcohols and/or alcohol derivatives can be added to the present fuel compositions for purposes other than lubricity. However such addition is avoided in all the preferred embodiments. Examples of other alcohols (including alcohol derivatives therefrom) include especially:

Linear Alcohols: Long-chain primary alcohols that are linear are disclosed in U.S. Pat. Nos. 5,689,031, 5,766,274, 5,814,109 and WO 98/34999 all assigned to Exxon.

Highly Branched Alcohols: Exxon further has disclosed in commerce certain long-chain alcohols that are highly branched; these are available as EXXAL® alcohols, derived from propylene and/or butylene oligomerization through acid catalysis to a range of monoolefins, the range having an average of $C_{13}$, but containing some $C_{10}$-$C_{15}$ other than $C_{13}$, and subsequent hydroformylation using an Oxo process. EXXAL® 13 for example has been reported to be a 3-4 methyl branched tridecyl alcohol known for its use in lubricants and in detergents of types not requiring rapid biodegradation. EXXAL® alcohols are referred to elsewhere herein as "alcohols comprising quaternized carbon and consisting of the Oxo product of acid-catalyzed propylene/butylene oligomerization". While the present invention avoids such alcohols in the preferred embodiments, partial use of EXXAL® alcohols in conjunction with the nonlinear primary aliphatic derivative component as defined herein might be contemplated, for example, by practitioners not requiring the maximum levels of biodegradation made possible when only nonlinear primary aliphatic derivative is used.

Other Alcohols

Also known in the art are alcohols such as amyl alcohol, which are related to certain cetane enhancers, and other alcohols, such as 2-ethylhexanol, comprising the aldol condensation product of certain aldehydes. These aldehydes are formed by Oxo reaction of low molecular weight olefins. In more detail, these aldehydes are aldol-condensed, dehydrated, and hydrogenated. Similarly alcohols can be dimerized under dehydrogenation/hydrogenation conditions in the presence of an aldol condensation catalyst; these are known as Guerbet alcohols, and are commercially available, for example as ISOFOL® alcohols from Condea.

A wide variety of Ziegler alcohols are known in the art; these are essentially linear and lie outside of the definition of nonlinear primary aliphatic Oxo alcohol derivatives herein.

In the manufacture of the NEODOL® alcohols, as is known in the art, see for example the background of U.S. Pat. No. 5,780,694, a predominantly linear olefin feed is subjected to hydroformylation by reacting carbon monoxide and hydrogen onto the olefin in presence of a specific Oxo catalyst; and generally, 80% or more of the number of alcohol molecules in the resultant alcohol composition are linear primary alcohols. It is further stated that of the branched primary alcohols in the composition, substantially all, if not all, of the branching is on the $C_2$ carbon atom relative to the hydroxyl bearing carbon atom. For the purposes of the present invention, current commercial NEODOL® alcohols lie outside of the definition of nonlinear primary aliphatic Oxo alcohol derivatives as used herein in defining an essential component of the invention. This exclusion is based on the combination of NEODOL's® 80%+linear content and the branching position which is almost exclusively located on the $C_2$ carbon atom.

Levels of Such Alcohols and/or Alcohol Derivatives

Suitable levels of such alcohols (and/or corresponding alcohol derivatives) are further illustrated by the following: compositions further comprising: (c) from about 0.001 ppm to about 30% of linear $C_{11}$ to $C_{21}$ alcohols; compositions further comprising: (d) from about 0.001 ppm to about 30% of $C_{12}$ to $C_{22}$ nonlinear primary aliphatic diols; and compositions further comprising: (e) from about 0.0001 ppm to about 3% of $C_{12}$ to $C_{22}$ linear primary aliphatic diols.

The invention also encompasses compositions further comprising: (f) from about 0.001 ppm to about 30% of a mixture of members selected from: linear $C_{11}$ to $C_{21}$ alcohols; $C_{12}$ to $C_{22}$ nonlinear primary aliphatic diols; and $C_{12}$ to $C_{22}$ linear primary aliphatic diols.

Compositions

In more detail, the present invention encompasses fuel compositions comprising nonlinear primary aliphatic derivatives of the present invention and certain fuel hydrocarbons. Encompassed compositions include those wherein said fuel hydrocarbons comprise at least two distinct types of fuel hydrocarbons and wherein at least about 0.6 weight fraction (to about 1.0 weight fraction) of the nonlinear primary aliphatic alcohol moiety of said nonlinear primary aliphatic alcohol derivatives are nonlinear primary aliphatic Oxo alcohol moieties comprising at least one $C_1$-$C_3$ alkyl substituent situated on a third or higher carbon atom counting from an Oxo alcohol moiety hydroxy group; and from zero to not more than about 0.02 weight fraction, preferably not more than about 0.001 weight fraction of said alcohol moiety comprises a quaternary substituted carbon atom.

In preferred compositions of this type, said at least two types of fuel hydrocarbons are differentiated in that a first type of fuel hydrocarbon is present which is selected from FISCHER-TROPSCH Oxo hydrocarbons and in that a second type of fuel hydrocarbon is present which is other than said first type of fuel hydrocarbon.

The present invention also includes fuel compositions comprising: (a) from about 5% to about 99.9990%, preferably from 10% to about 99.990%, of said fuel hydrocarbons and (b) from about 10 ppm to about 95%, preferably from 100 ppm to about 90%, of said nonlinear primary aliphatic Oxo alcohol derivative; wherein said fuel hydrocarbons comprise FISCHER-TROPSCH Oxo hydrocarbons; and the nonlinear primary aliphatic Oxo alcohol moieties of said alcohol derivatives have an average of from about 11 to about 21 carbon atoms; said composition further comprising a member selected from the group consisting of: (c) linear long-chain ($C_{11}$-$C_{21}$) monoalcohols and/or derivatives thereof, preferably linear long-chain ($C_{11}$-$C_{21}$) Oxo monoalcohols and/or derivatives thereof; (d) nonlinear ($C_{12}$-$C_{22}$) diols and/or derivatives thereof, preferably nonlinear ($C_{12}$-$C_{22}$) Oxo diols and/or derivatives thereof; (e) linear ($C_{12}$-$C_{22}$) diols and/or derivatives thereof, preferably linear ($C_{12}$-$C_{22}$) Oxo diols and/or derivatives thereof, and mixtures of two or more of (c)-(e).

Also included herein is a composition wherein said components (b) nonlinear aliphatic Oxo alcohol derivative and (c) linear long-chain alcohols and/or derivatives thereof are present at a (b):(c) ratio of at least about 2:1, preferably at least about 10:1, more preferably at least about 100:1 by weight. When nonlinear ($C_{12}$-$C_{22}$) diols and/or derivatives thereof are present, typically the weight ratio (b):(d) is about 2:1, more preferably about 10:1. The ratio (d):(e) is typically about 10:1, preferably higher. Preferably the content of linear long-chain ($C_{11}$-$C_{21}$) monoalcohols and/or derivatives thereof, is such that (c) or (e) or the sum of (c)+(e), is selected such that it approaches zero as the carbon number increases above 12.

Important embodiments of the present invention include those wherein there is little or no diol and/or diol derivatives present, especially when diol and/or diol derivative is linear. There is a preference to select nonlinear diols and/or nonlinear diol derivatives and to avoid linear ones.

Concentrates (Nonlinear Primary Aliphatic Derivative and FISCHER-TROPSCH Oxo Hydrocarbon)

Also included in the present invention are compositions comprising from about 20% to about 95%, typically from about 30% to about 60%, of said nonlinear primary aliphatic Oxo alcohol derivative; and wherein said fuel hydrocarbons, (a), comprise from about 5% to about 80%, preferably from about 40% to about 70%, of a first type of fuel hydrocarbons selected from FISCHER-TROPSCH Oxo hydrocarbons; and wherein at least about 0.8 weight fraction to about 1.0 weight fraction of the alcohol moieties of said nonlinear primary aliphatic Oxo alcohol derivatives comprise at least one $C_1$-$C_3$ alkyl substituent situated on a third or higher carbon atom counting from an Oxo alcohol moiety hydroxy group; wherein from zero to about 0.01 weight fraction of, alcohol moieties of said nonlinear primary aliphatic Oxo alcohol derivatives comprise a quaternary substituted carbon atom.

Blendstocks Comprising Nonlinear Primary Aliphatic Derivative, FISCHER-TROPSCH Oxo Hydrocarbons and FISCHER-TROPSCH non-Oxo Hydrocarbons The present invention also includes compositions include those having the form of blendstocks having both FISCHER-TROPSCH Oxo hydrocarbons and FISCHER-TROPSCH non-Oxo hydrocarbons. These are illustrated by fuel compositions comprising from about 0.1% to about 19% of said nonlinear primary aliphatic Oxo alcohol derivative; and wherein the fuel hydrocarbons described above in subsection (a) of the fuel composition, comprise: (i) from about 0.05% to about 18% of a first type of fuel hydrocarbons selected from FISCHER-TROPSCH Oxo hydrocarbons and (ii) from about 80% to about 99% of a second type of fuel hydrocarbons selected from FISCHER-TROPSCH non-Oxo hydrocarbons; and wherein about 0.8 weight fraction to about 1.0 weight fraction of the alcohol moieties of said nonlinear primary aliphatic Oxo alcohol derivatives comprises at least one $C_1$-$C_3$ alkyl substituent situated on a third or higher carbon atom counting from an Oxo alcohol moiety hydroxy group; wherein from zero to about 0.001 weight fraction of the alcohol moieties of said nonlinear primary aliphatic Oxo alcohol derivatives comprises a quaternary substituted carbon atom.

When two types of fuel hydrocarbons are present such as FISCHER-TROPSCH Oxo hydrocarbons and FISCHER-TROPSCH non-Oxo hydrocarbons, compositions may suitably have a ratio of said second type of fuel hydrocarbons to said first type of fuel hydrocarbons of at least about 10:1 to about 50000:1 by weight; preferably from about 100:1 to about 50000:1 by weight.

The present invention also includes compositions having the form of a "concentrate" as defined hereinabove. For example a concentrated fuel additive comprising from about 0.2% to about 19% of said nonlinear primary aliphatic Oxo alcohol derivative and from about 81% to about 99.8% of said fuel hydrocarbons; and wherein the alcohol moieties of said nonlinear primary aliphatic Oxo alcohol derivatives have an independently variable degree of branching, $DOB_a$, which exceeds the degree of branching of said fuel hydrocarbons, $DOB_F$, according to the relation: $DOB_a=DOB_F+0.3$. In highly preferred embodiments of this type, the fuel hydrocarbons consist essentially of a mixture of FISCHER-TROPSCH Oxo hydrocarbons and FISCHER-TROPSCH non-Oxo hydrocarbons, with the latter being the predominant component. DOB or degree of branching is the number of branches in a molecule. For example, when dealing with a mixture of branched fuel hydrocarbon compounds, $DOB_F$ is the $^1H$ NMR integral of methyl moieties minus two. When dealing with a nonlinear alcohol moiety mixture, $DOB_a$ is the integral of methyl moieties minus one.

Other fuel compositions herein can have the form of blendstocks or finished fuels and comprise from about 0.01% to about 10%, preferably no more than about 1%, of said nonlinear primary aliphatic Oxo alcohol derivative; and wherein said fuel hydrocarbons (a) of the above described fuel composition, comprise: (i) from about 0.005% to about 12% of a first type of fuel hydrocarbons selected from FISCHER-TROPSCH Oxo hydrocarbons; (ii) from 0% to about 99.8% of a second type of fuel hydrocarbons selected from FISCHER-TROPSCH non-Oxo hydrocarbons; and (iii) from about 0.1%, preferably at least 5%, to about 99.995% of at least one other type of fuel hydrocarbons selected from fuel hydrocarbons other than (i) and (ii); and wherein at least about 0.6 weight fraction (preferably from about 0.8 to about 1.0 weight fraction) of the alcohol moieties of said nonlinear primary aliphatic Oxo alcohol derivatives, (b), comprises at least one $C_1$-$C_3$ alkyl substituent situated on a third or higher carbon atom counting from an Oxo alcohol moiety hydroxy group.

Such compositions include those wherein said third type of fuel hydrocarbon, (iii) is present at non-zero levels, for example, such compositions comprising, at least about 0.1 weight fraction saturated cyclic hydrocarbons; and wherein all other types of fuel hydrocarbons present comprise less than about 0.05 weight fraction of saturated cyclic hydrocarbons. When three types of fuel hydrocarbons are present i.e., (i) FISCHER-TROPSCH Oxo hydrocarbons, (ii) FISCHER-TROPSCH non-Oxo hydrocarbons and (iii) a type of fuel hydrocarbon which is other than FISCHER-TROPSCH-derived, the composition may suitably have a ratio of said other type, (iii), of fuel hydrocarbons to said first type, (i), of fuel hydrocarbons of at least about 10:1 to about 50,000:1 by weight.

Finished Fuel-Diesel

In the diesel fuel embodiments of the invention, there is included a composition wherein said combustion engine is a diesel engine; and wherein said fuel hydrocarbons comprise from about 10 to about 20 carbon atoms; and said composition has:

- a flow point of −10° C. or below; and optionally but preferably
- a cetane number of at least about 45, preferably about 50 or higher;
- a sulfur content of less than 50 ppm, preferably between zero ppm and about 5 ppm; and
- an aromatics content of less than about 10% by weight, preferably between zero ppm and about 5% by weight, more preferably between zero ppm and 1% by weight. Pragmatically, the latter aromatics content is often measured as volume %, and in this case, the differences between weight % and volume % are relatively small.

A preferred composition of the type adapted for use as diesel fuel comprises: (a) at least about 90% of said fuel hydrocarbons; and (b) from about 100 ppm to 5%, preferably about 500 ppm to about 3% of said nonlinear primary aliphatic Oxo alcohol derivatives wherein the alcohol moiety of the derivative has from about 11 to about 21 carbon atoms, preferably from about 12 to about 17 carbon atoms.

Note that in the above diesel fuel embodiments, it will be typical for the fuel hydrocarbon component to have a relatively wider distribution of carbon atom content than is present in the nonlinear alcohol moiety of the alcohol derivative of the same composition.

Finished Fuel-Jet

In the jet fuel embodiments of the invention, there is included a composition wherein said combustion engine is a jet engine; said fuel hydrocarbons comprise from about 9 to about 14 carbon atoms; and said composition has a flow point of −47° C. or below; and a smoke point of at least 18 mm wick. The latter millimeters length of wick measure is well known in the industry. Such a jet fuel has a sulfur content of from about zero ppm to less than about 50 ppm, preferably less than about 5 ppm.

A preferred composition of the type adapted for use as jet fuel comprises: (a) at least about 90% of the fuel hydrocarbons; and (b) from about 100 ppm, preferably about 500 ppm, to about 5% of the nonlinear primary aliphatic Oxo alcohol derivatives wherein the alcohol moieties of the nonlinear primary aliphatic Oxo alcohol derivatives has from about 11 to about 17 carbon atoms, preferably from about 12 to about 17 carbon atoms. These jet fuel compositions include ones in which the nonlinear primary aliphatic Oxo alcohol moieties of the alcohol derivatives contain more carbon atoms than do the fuel hydrocarbons. To illustrate, specifically included are jet fuel compositions wherein the fuel hydrocarbon has from about 9 to about 14 carbon atoms and the alcohol moiety of the nonlinear primary aliphatic Oxo alcohol derivative has a hydrocarbon chain containing an overall number of carbon atoms in the range 14-17.

Finished Fuel-New Engines

In the fuel for new engine types embodiments of the invention, there is included a composition wherein the combustion engine is a new compact diesel or other non-traditional engine; the fuel hydrocarbons comprise from about 5 carbon atoms to about 14 carbon atoms; and the composition has a flow point of −25° C. or below, preferably −47° C. or below; and preferably, a cetane number of at least about 45, preferably about 50 or higher, more preferably at least about 60 or higher; a sulfur content of less than about 50 ppm, preferably less than about 5 ppm to about zero ppm; and an aromatics content of less than about 10 volume %, preferably less than about 1% by weight. Preferred in such compositions are those comprising: (a) at least about 90% to about 99.9% of the fuel hydrocarbons; and (b) from about 100 ppm to about 10% of the nonlinear primary aliphatic Oxo alcohol derivatives. The specification for new, non-traditional diesel fuel is, for example, in general accordance with the specification ranges of U.S. Pat. No. 5,807,413.

These fuel compositions of the present invention for new types of engines include ones in which the nonlinear primary aliphatic Oxo alcohol moieties of the alcohol derivatives contain more carbon atoms than do the fuel hydrocarbons. To illustrate, specifically included are fuel compositions wherein the fuel hydrocarbon has from about 7 to about 12 carbon atoms, or from about 9 to about 14 carbon atoms, and the alcohol moiety of the nonlinear primary aliphatic Oxo alcohol derivative in the same fuel composition has a hydrocarbon chain containing an overall number of carbon atoms in the range 14-17.

Concentrates

Particularly desirable "concentrates" herein include fuel compositions having the form of a concentrated fuel additive, comprising: from about 5% to about 90% of the fuel hydrocarbons and from about 10% to about 95% of the nonlinear primary aliphatic Oxo alcohol derivative; wherein the fuel hydrocarbons are derived from FISCHER-TROPSCH wax, petroleum wax and mixtures thereof, preferably wherein the fuel hydrocarbons are derived from FISCHER-TROPSCH wax, and the fuel hydrocarbons comprise the FISCHER-TROPSCH-Oxo hydrocarbons; and the alcohol moiety of the nonlinear primary aliphatic Oxo alcohol derivative is in the form of a two-carbon alcohol cut selected from a $C_{12}$-$C_{13}$ cut, a $C_{14}$-$C_{15}$ cut and a $C_{16}$-$C_{17}$ cut.

Other Concentrates

Also particularly desirable "concentrates" herein include fuel compositions having the form of a concentrated fuel additive comprising from about 5% to about 90% of the fuel hydrocarbons and from about 10% to about 95% of the nonlinear primary aliphatic Oxo alcohol derivative; wherein the fuel hydrocarbons are derived from FISCHER-TROPSCH wax, petroleum wax and mixtures thereof, preferably wherein the fuel hydrocarbons are derived from FISCHER-TROPSCH wax and the fuel hydrocarbons comprise the FISCHER-TROPSCH-Oxo hydrocarbons; and the alcohol moiety of the nonlinear primary aliphatic Oxo alcohol derivative is in the form of a four-carbon alcohol cut selected from a $C_{14}$-$C_{17}$ cut.

Preferred Finished Fuels

Among the finished fuel embodiments, the invention includes a fuel composition for internal combustion engines, the fuel composition having co-optimized combustion and fuel lubricity/transport/storage properties for applications demanding low sulfur content, the fuel composition comprising: (a) from about 5% to about 100% of fuel hydrocarbons wherein the fuel hydrocarbons comprise (i) from about 1 ppm to about 10% by weight of the overall composition of a first type of fuel hydrocarbons having from about 10 to about 20 carbon atoms selected from FISCHER-TROPSCH Oxo hydrocarbons; and at least one additional type of fuel hydrocarbons having at least about 5 to about 20 carbon atoms. This additional type of fuel hydrocarbons is a member selected from: (ii) from 0% to about 99% of a second type of fuel hydrocarbons selected from FISCHER-TROPSCH non-Oxo hydrocarbons and (iii) from 0% to about 99% of at least one other type of fuel hydrocarbons, other than (a)(i) and (a)(ii); provided that the sum of (a)(ii) and (a)(iii) is at least about 80% of the fuel composition.

The fuel composition also comprises (b) at least about 10 ppm of nonlinear primary aliphatic Oxo alcohol derivatives wherein the alcohol moieties of the derivatives have at least about 11 to about 21 carbon atoms wherein at least 0.6 weight fraction of the alcohol moieties of the nonlinear primary aliphatic Oxo alcohol derivatives comprises at least one $C_1$-$C_3$ alkyl substituent situated on a third or higher carbon atom counting from an Oxo alcohol moiety hydroxy group; and from zero to about 0.01 weight fraction, preferably not more than about 0.001 weight fraction of the alcohol moieties of the nonlinear primary aliphatic Oxo alcohol derivatives comprises a quaternary substituted carbon atom; and (c) at least about 0.001 ppm of linear primary Oxo alcohol derivatives, wherein the alcohol moieties of the alcohol derivative have at least about 11 carbon atoms; wherein the fuel has a ratio by weight {(a)(ii)+(a)(iii)}:(a)(i) of at least about 10:1; a ratio by weight (b):(c) of at least about 1:10, preferably at least 1:2, more preferably at least 2:1, more preferably still at least 10:1; and a low level of sulfur, of from zero ppm to no more than about 50 ppm, preferably no more than about 5 ppm.

Preferred among such fuel compositions of the present invention are those having an independence of the average number of carbon atoms of the alcohol moiety of component (b) as compared with {(a)(i)+(a)(ii)+(a) (iii)}; and wherein the composition is produced by a process having at least one step of blending a preformed concentrated fuel additive comprising at least the components (a)(i), (b) and (c) with a portion of the fuel hydrocarbons, the portion being selected from (a)(ii), (a)(iii) and (a)(ii)+(a)(iii). In the above, independence refers to the fact that whereas the average number of carbon atoms of the alcohol moiety of component (b) and the average number of carbon atoms of component (a)(i) are linked, the sum {(a)(i)+(a)(ii)+(a) (iii)} is dominated by components other than (a)(i), permitting the latter average to vary independently for all practical purposes. Further, preferably, the component, (a)(iii), comprises at least 0.1 weight fraction saturated cyclic hydrocarbons, e.g., cyclohexanes, cyclopentanes or other saturated cyclic hydrocarbons comprising two or more rings selected from six-membered carbon rings and five-membered carbon rings; whereas the components, (a)(i) and (a)(ii), each comprise less than about 0.05 weight fraction of saturated cyclic hydrocarbons.

Processes and Products of the Process

The present invention also includes processes for making the compositions, and forms of the compositions derivable by the specific preferred processes. In their simplest form, the processes include one or more blending steps. Thus, in its blendstock or finished fuel embodiments, the present invention encompasses a fuel composition having the form of a fuel blendstock or finished fuel composition prepared by blending any of the above-identified mixtures of nonlinear primary aliphatic derivatives and a first type of hydrocarbon (FISCHER-TROPSCH Oxo hydrocarbon) with any fuel hydrocarbon, fuel blend stock or fuel not comprising the first type of fuel hydrocarbon.

Preferred fuel compositions herein also include those wherein the components (a) and (b), (or at least part of (a) and all of (b)) i.e., FISCHER-TROPSCH Oxo hydrocarbon a(i) and the nonlinear primary aliphatic derivative, are cosynthesized. By "cosynthesized" is meant that the nonlinear alcohol is prepared by at least one step of reacting in an Oxo reactor and that the FISCHER-TROPSCH Oxo hydrocarbon is also present in that reactor. The nonlinear alcohol is derivatized in accordance with the present invention after the Oxo step and before or after any optional distillation step following the Oxo step. Note that by our definition, the Oxo hydrocarbon needs to have been present in the alcohol synthesis reactor, however, it need not have been chemically formed or changed in that reactor.

Other preferred compositions herein are the product of blending the fuel hydrocarbons and members of the nonlinear primary aliphatic Oxo alcohol derivatives synthesized nonintegrally with components of the fuel hydrocarbons, thereby achieving higher ratios, (b):(c), of the nonlinear primary aliphatic Oxo alcohol derivatives (b) to linear Oxo alcohol and/or it's a linear Oxo alcohol derivative (c) than can be attained by known FISCHER-TROPSCH wax processes for making oxygenated fuels. By the term "synthesized nonintegrally" is meant that the nonlinear primary aliphatic Oxo alcohol derivatives referred to are not FISCHER-TROPSCH "native" alcohols nor derivatives thereof (see the discussion of "native" FISCHER-TROPSCH alcohols elsewhere herein).

In terms of the process by which they can be made, the fuel compositions herein, for example those for use as jet fuel or diesel fuel, include those which can be described as comprising the product of blending: (a) from about 90% to about 99.9% of fuel hydrocarbons having from about 9 carbon atoms to about 20 carbon atoms; and (b) from about 100 ppm to about 10% of nonlinear primary aliphatic Oxo alcohol derivatives, wherein the nonlinear primary aliphatic Oxo derivatives are the product of a process, preferably nonintegral with the process of forming the component (a), wherein the process comprises: (I) a first stage comprising: providing a member selected from (A) FISCHER-TROPSCH wax; (B) conventional petroleum wax; (C) a fuel hydrocarbon distillation cut in the jet/diesel range, the distillation cut comprising at least about 0.8 weight fraction to about 1.0 weight fraction of linear paraffins, mono-, di- or tri-$C_1$-$C_3$ branched acyclic paraffins, or mixtures thereof; (D) mixtures thereof to form a first stage product; (preferably between stage (I) and (II) distilling as needed); (II) a pre-Oxo stage comprising sequentially or concurrently delinearizing and preparing the first stage product for Oxo reaction, the pre-Oxo stage comprising two or more steps to form a pre-Oxo stage product, in any order selected from steps capable of effecting (i) chain-breaking, (ii) branch-forming and (iii) olefin-forming; and (III) an Oxo/post-Oxo stage comprising converting the pre-Oxo stage product to the nonlinear Oxo alcohol, the Oxo/post-Oxo stage comprising at least one Oxo step and further optionally comprising a step selected from an Oxo aldehyde to alcohol conversion step(s), including a step of hydrogenating residual olefins to paraffins, and combinations thereof; and (IV) a derivatizing stage wherein the nonlinear Oxo alcohol is derivatized in accordance with the present invention. Optionally in stage (III), any residual olefin can be hydrogenated to paraffin. The corresponding process, as distinct from its product, is likewise within the spirit and scope of the present invention.

A simple process embodiment of the present invention has two process batteries, e.g., A and B. Both of these batteries are present in each of FIGS. 1*a* and 1*b*. The input stream, 1, differs in FIG. 1*a* and FIG. 1*b*. In FIG. 1*a*, the input stream is suitably petroleum wax, and in FIG. 1*b*, the input stream is suitably FISCHER-TROPSCH wax. Such a process stream 1 is preferably derived from modern FISCHER-TROPSCH slurry-phase technology.

Figure 1B:
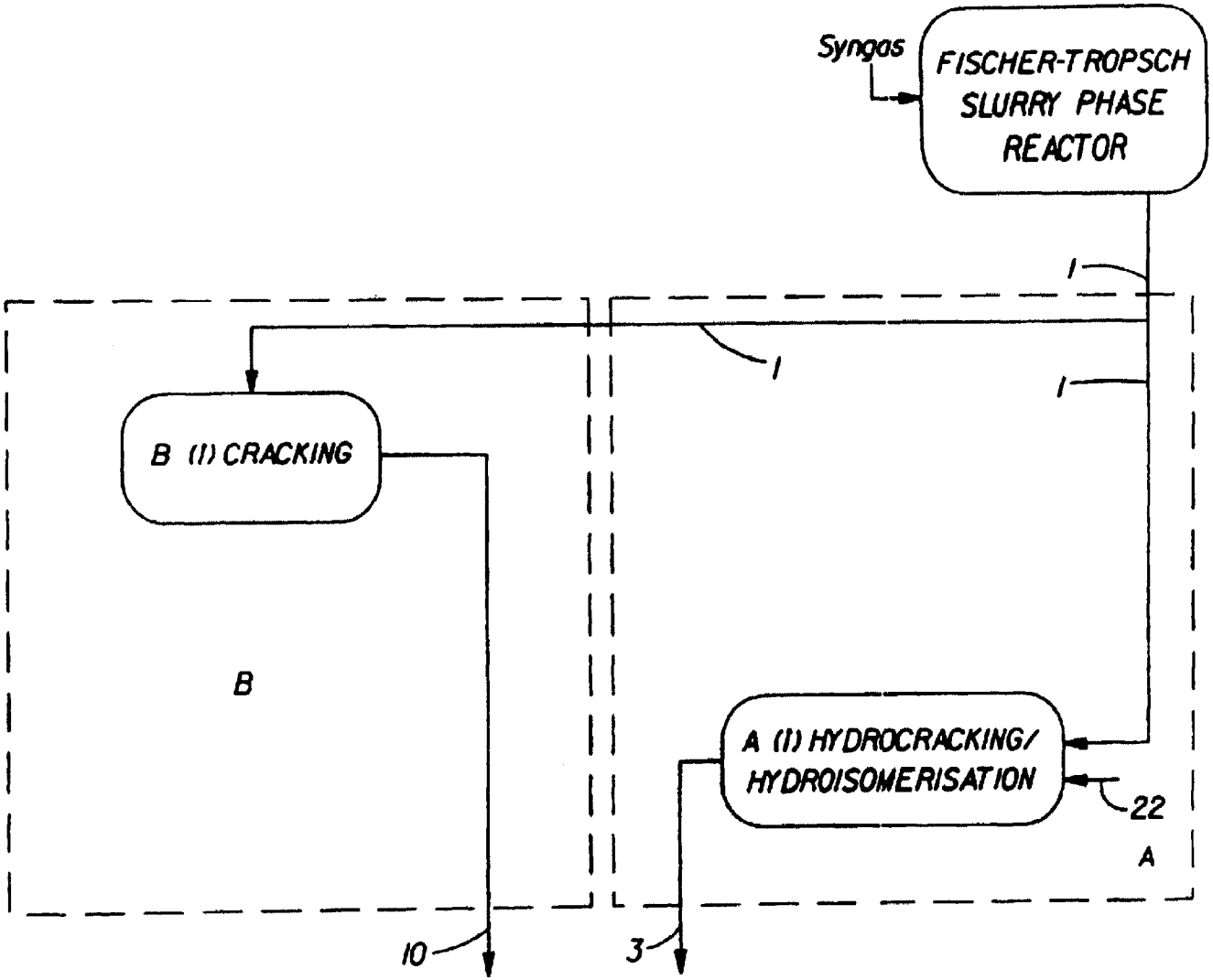
FIG. 1*b* is a flow diagram representing a process embodiment of the present invention having two process batteries preferably for use with FISCHER-TROPSCH wax.

In each of FIGS. 1*a* and 1*b*, the first battery, A, is a large-scale fuel-making battery, which includes the largest streams of the process in terms of volume. In each of FIGS. 1*a* and 1*b*, the waxy stream, 1, is split and a portion is sent to battery B where it is cracked to long-chain alpha-olefins and paraffins in one or more steps shown as unit B(i), substantially in the absence of added hydrogen, unlike the main portion of stream 1 which is hydrocracked/hydroisomerized in one or more steps shown as unit A(i) in the presence of added hydrogen. (stream 22). The art on hydrocracking/hydroisomerization is extensive; see for example "Hydrocracking Science and Technology", J. Scherzer and A. J. Gruia, Marcel Dekker, N.Y., 1996, ISBN 0-8247-9760-4, see especially Chapters 10 and 13. Wax cracking reactions or process steps conducted without added hydrogen are referenced in GB 843,385; U.S. Pat. Nos. 2,945,076 and 2,172,228. Note that B(i) uses old detergent manufacturing technology which is not at all conventional at such long chain-lengths in modern fuel-making plants.

Figure 2:
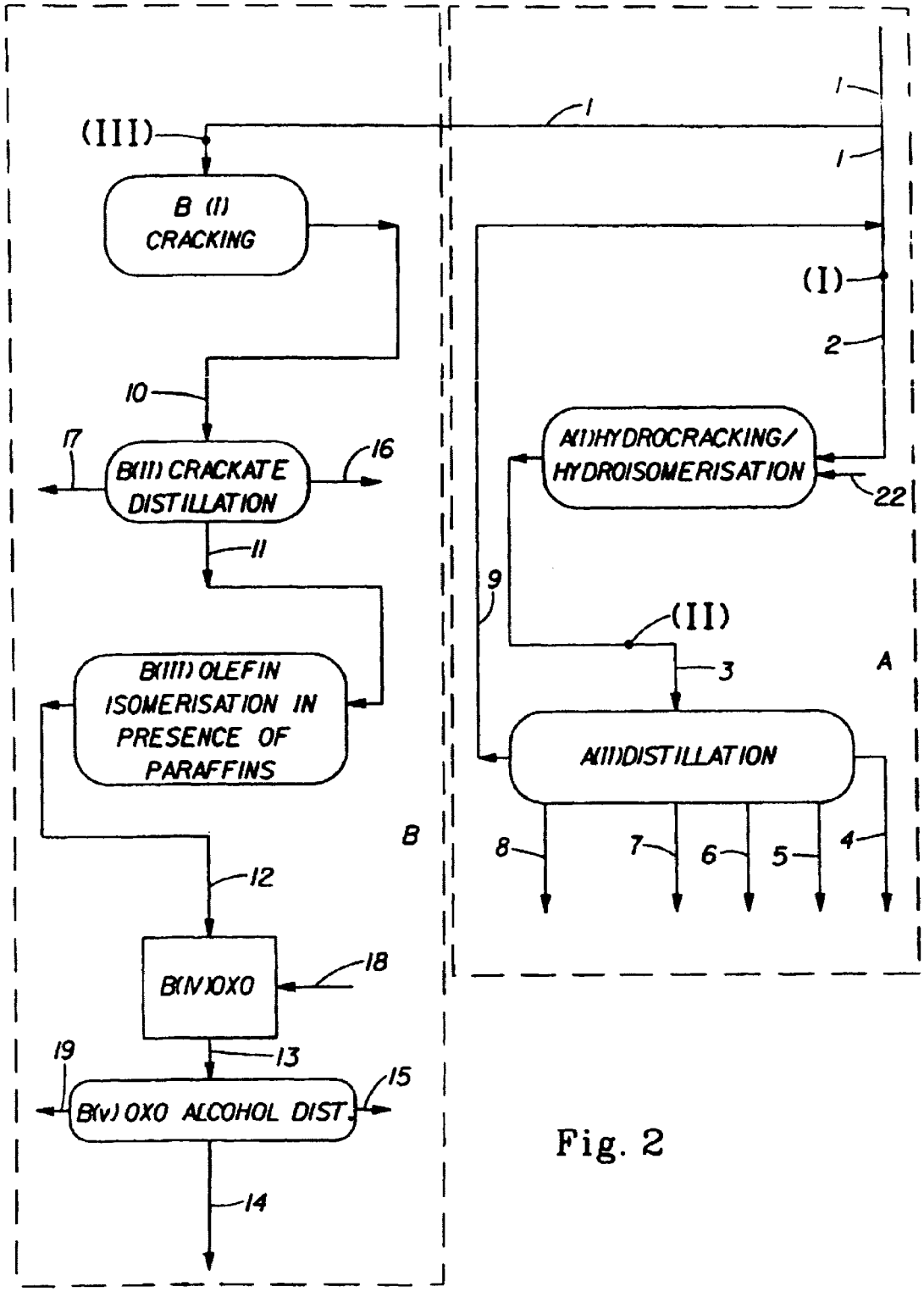
FIG. 2 is a flow diagram representing a process embodiment of the present invention having two process batteries.
Figure 3:
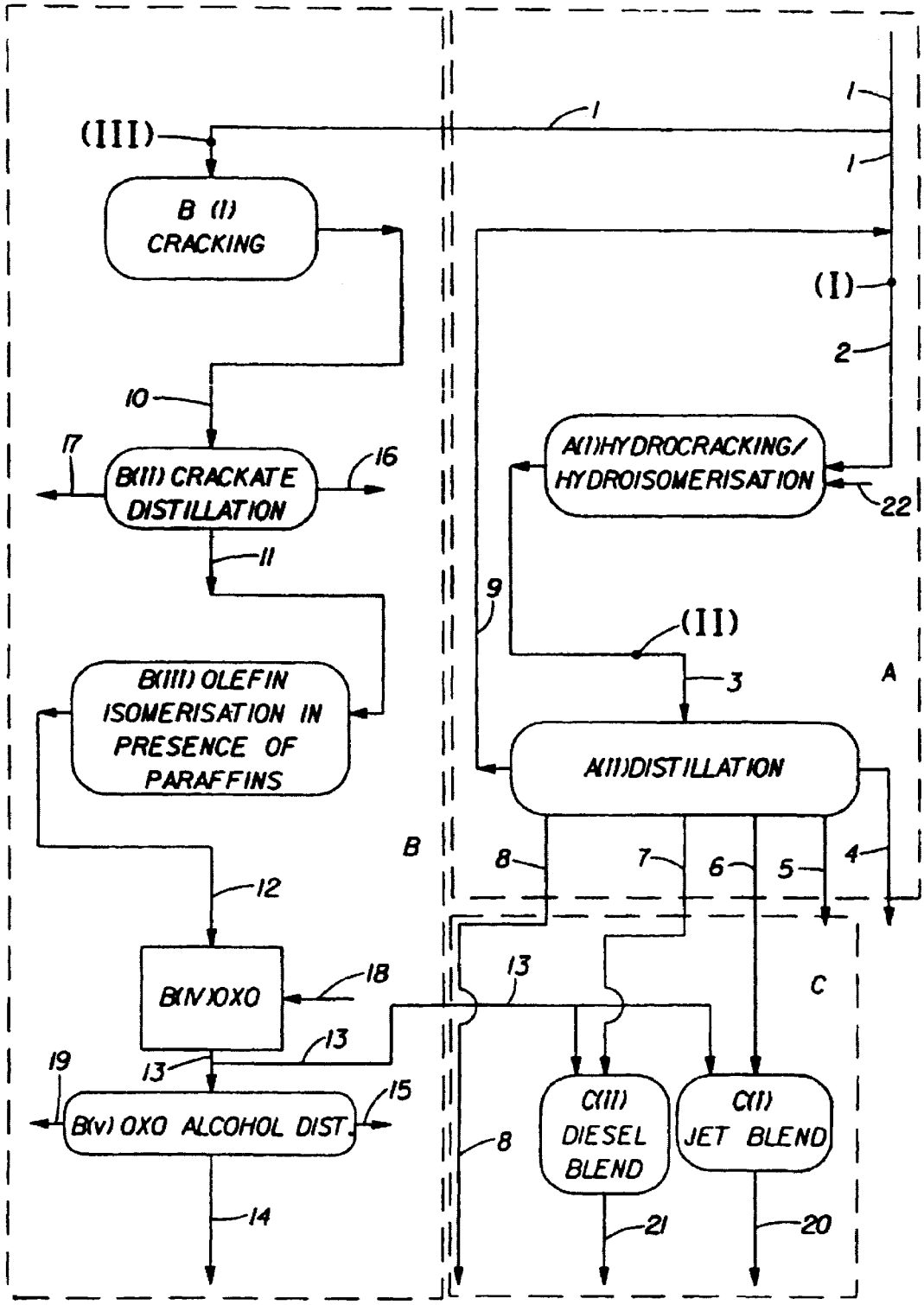
FIG. 3 is a flow diagram representing a process embodiment of the present invention having three process batteries.
Figure 5:
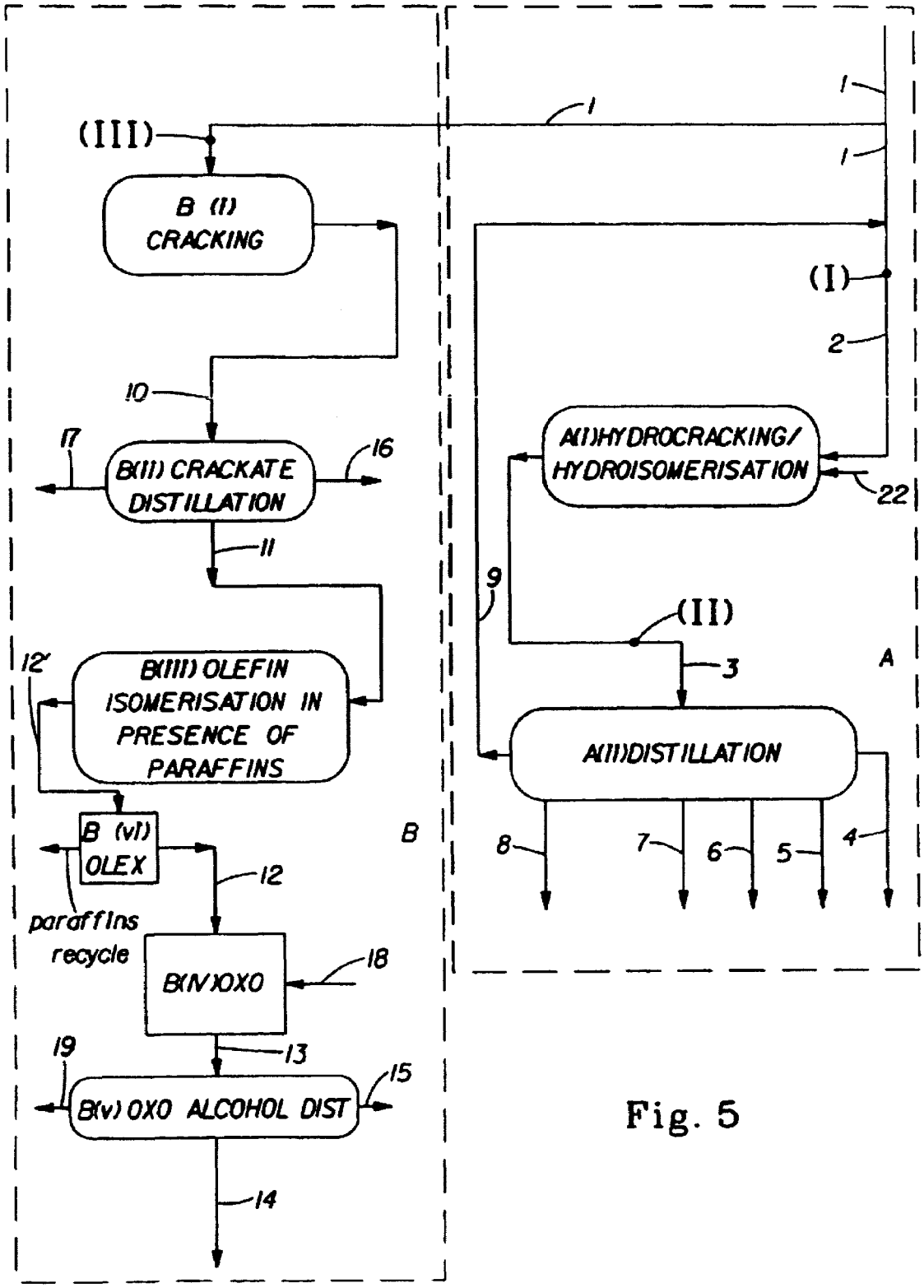
FIG. 5 is a flow diagram representing a process embodiment of the present invention having an olefin/paraffin separator.

Once stream 10 from unit B(i) has been secured, it is in accordance with the present invention to convert it to nonlinear primary aliphatic Oxo alcohols via, for example, isomerization in unit B(iii), in FIGS. 2, 3 and 5, by means of at least one Oxo reaction step in unit B(iv) in FIGS. 2, 3 and 5. The nonlinear primary aliphatic Oxo alcohols are then reacted with appropriate reactants and under appropriate conditions, depending upon the desired alcohol derivative.

For example, if alcohol esters are desired, then the nonlinear primary aliphatic Oxo alcohols are reacted with a carboxylic acid, preferably in the presence of an acid catalyst. On the other hand, if alcohol alkoxylates or alcohol glycerin ethers are desired, then the nonlinear primary aliphatic Oxo alcohols are reacted with an epoxide or an alcohol epoxide, respectively, preferably in the presence of an alkaline earth metal, such as sodium. Further, if alcohol acid esters are desired, then the nonlinear primary aliphatic Oxo alcohols are reacted with a dicarboxylic acid or preferably anhydride such as maleic acid and/or maleic anhydride, or succinic acid and/or succinic anhydride, and/or phthalic acid and/or phthalic anhydride. Another example is if C10 or higher carboxylic acids are desired, the nonlinear primary aliphatic Oxo alcohols are reacted with acrylonitrile and hydrolyzed in an aqueous acidic solution. Once the desired alcohol derivatives are produced, then such alcohol derivative can be blended with fuel hydrocarbons in a variety of different ways, for example as shown in blending battery C of FIG. 3.

Figure 4:
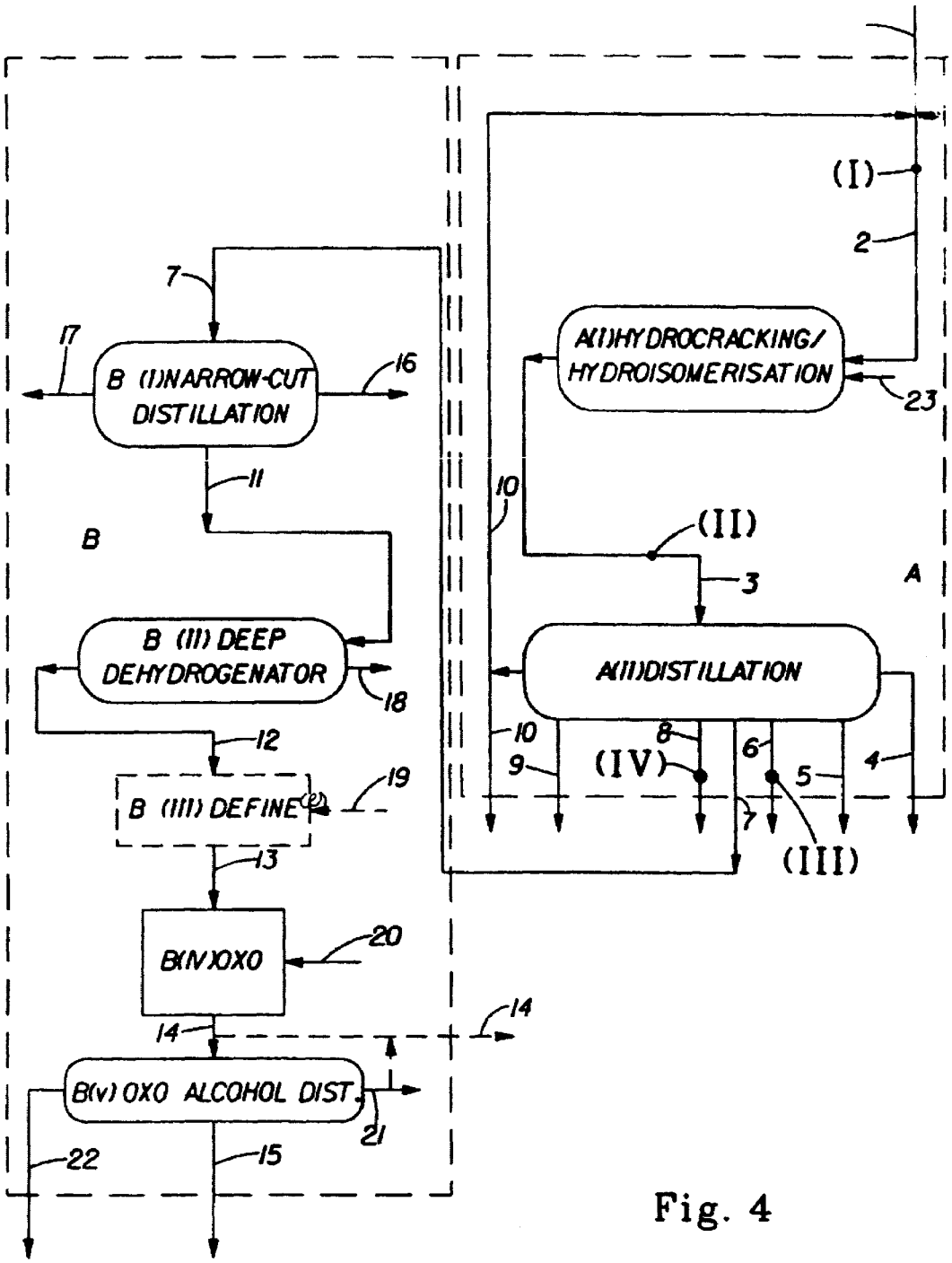
FIG. 4 is a flow diagram representing a process embodiment of the present invention having two process batteries with a distillation unit in one process battery.

Another preferred process embodiment is nonlimitingly illustrated in FIG. 4, which differs from the other Figures in that the offtake from battery A to battery B is from the product distillate tower shown by unit A(ii), i.e., at the back end of battery A.

Now in more detail with reference to FIG. 2, this shows a configuration in which the crackate stream, 10, is distilled to a narrow-cut, stream 11 in unit B(ii), which is skeletally isomerized (see, for example U.S. Pat. No. 5,589,442 using as catalyst Pt-SAPO or U.S. Pat. No. 5,849,960 using as catalyst Pd/ferrierite of U.S. Pat. No. 5,510,306) in unit B(iii), and the effluent stream, 12, comprising linear paraffins and mid-chain methyl-branched internal olefins, is reacted in a process comprising one or more Oxo steps (unit(s) B(iv)) under conditions in which the hydroformylation reaction occurs preferably at a terminal carbon atom. Unit B(iv) typically also includes means, not shown in the drawings, for reducing intermediate aldehydes to alcohols.

The resulting alcohol-rich stream, 13 in FIGS. 2, 3 and 5, (or 14 in FIG. 4), in accordance with one embodiment of the invention, comprises a mixture rich in nonlinear primary aliphatic Oxo alcohols and which also contains FISCHER-TROPSCH Oxo hydrocarbons: the alcohols are then reacted with appropriate reactants and under appropriate conditions to produce the desired alcohol derivatives, as described above in the discussion about FIG. 1. Note that in the foregoing, FISCHER-TROPSCH Oxo hydrocarbons present in the alcohol-rich stream 13 in FIGS. 2, 3 and 5 can be separated by distillation prior to its derivatization, resulting in a hydrocarbon-stripped alcohol rich stream 14 in FIGS. 2, 3 and 5, which is then derived in accordance with the present invention, and a FISCHER-TROPSCH Oxo hydrocarbon rich stream 15 in FIGS. 2, 3, and 5. This separation is greatly facilitated by the fact that the alcohol has a net gain of one carbon and one oxygen atom as compared to the hydrocarbon. Note also that streams such as 15 or 19 in FIGS. 2, 3, and 5, the latter of which also may include olefin dimers and/or diols, can simply be sent back to the main fuel distillation column, e.g., entering battery A at point (II) or battery A at point (I), or can be blended directly into distillate streams, e.g., 4-8 in FIGS. 2, 3, and 5. Similarly crackate waste streams 16 and 17 in FIGS. 2, 3, and 5 can be sent back to battery A, point (II), for distillation.

FIG. 3 differs from FIG. 2 in that it further nonlimitingly illustrates the use of a blending battery, C, in which one or more derivatives of the nonlinear primary aliphatic Oxo alcohol-rich stream 13, in accordance with the present invention, is blended with jet and/or diesel cuts to produce blend stocks. The blend stocks can be further diluted with fuel hydrocarbons from the process of the present invention or from other sources to provide other compositions of the present invention, as described above.

In FIG. 4, crude FISCHER-TROPSCH wax 1 combined with a recycle stream 10 pass into a hydrocracking/hydroisomerization reactor as stream 2. Stream 23 is hydrogen. Stream 3 comprising hydrocracked, hydroisomerized hydrocarbons in the form of a broad range and mix of paraffins such as $C_4$-$C_{30}$ including methyl branched compounds) passes to a distillation section of unit A(ii). Distillation cuts from this section of the battery include streams suitable for jet 6, and diesel 8 in FIG. 4. A fraction from within an overall boiling range of $C_{10}$-$C_{20}$, preferably above $C_{11}$, more preferably from $C_{13}$-$C_{16}$, is taken as a side-stream, 7 in FIG. 4, and is led to battery B for processing into nonlinear primary aliphatic Oxo alcohols and subsequently into nonlinear primary aliphatic Oxo alcohol derivatives, as further defined elsewhere herein.

In FIG. 4, a first stage in battery B is to secure a relatively narrow heart cut, 11, with sharp boiling point initiation and cut-off preferably from about a two-carbon to about a four-carbon heart cut, 11. The top streams 16 and bottom stream 17, are blended back to appropriate mixing points (I, II, III, and IV) in battery A. The heart cut stream, 11, that is rich in random methyl-branched paraffins, is dehydrogenated in B(iii) to give a stream 12 having a conversion of about 35% to about 90% of olefin. The stream 12 may additionally comprise about zero to about 10% diolefin. The stream 12 composition is illustrative of what can be termed a "deep dehydrogenation" for the present invention. Exhaust stream 18 carries off hydrogen and any low boiling crackates generated. Stream 12, rich in methyl-branched olefins, is optionally further processed via a diolefin-to-olefin hydrogenator such as a commercial DEFINE® type unit.

In FIG. 4, stream 12 or 13 carries output from the dehydrogenator, optionally via the DEFINE® hydrogenator, to an Oxo unit B(v). In the latter, preferentially, the double bonds of any internal olefins present in the stream 13 are isomerized to become terminal and are hydroformylated to give a stream 14 comprising nonlinear primary aliphatic Oxo alcohols defined above, with the majority component of stream 14 being methyl branched paraffins suitable for use as fuel FISCHER-TROPSCH Oxo hydrocarbons, which have been carried through the process. Optionally, in the Oxo reactor unit B(iv) is a polishing hydrogenation of the inherent intermediate aldehyde-to-alcohol step, not shown. Stream 20, as shown in FIG. 4 is a carbon monoxide/hydrogen gas mixture.

Stream 14, after derivatization in accordance with the present invention, is suitable as a concentrated fuel additive such as a "fungible" lubricant additive concentrate or optionally, as shown in FIG. 4 represented by the dashed line, for back blending into jet/diesel streams of battery A to form fungible blendstocks or finished fuels. If desired, and as shown in FIG. 4, a further distillation stage B(v) can be used to secure the nonlinear primary aliphatic Oxo alcohols from stream 15, prior to derivatization that is essentially free from fuel hydrocarbons, which can be useful, for example, to the manufacturers of detergents or other products. Recovered hydrocarbon stream 21 can be recycled and bottom stream 22, containing nonlinear diols, derivatized or non-derivatized, which can be useful in and of themselves as fuel lubricants, can be added into appropriate blending streams, or can be useful for other purposes.

FIG. 5 represents a process rather similar to that described in connection with FIG. 2, with the exception or variation that an additional unit B(vi) is present which is an olefin/paraffin separator. For example, the additional unit B(vi) may be used when the processes are relying on adsorptive separation on zeolites, e.g., an OLEX® unit. This unit can be used to increase the olefin/paraffin ratio in the stream entering Oxo reactor unit B(iv). Thus, specifically, stream 12 in FIG. 5 as it enters the Oxo unit B (iv) has a higher olefin/paraffin ratio than does stream 12 in FIG. 2 as it enters the Oxo unit B(iv).

Figure 6:
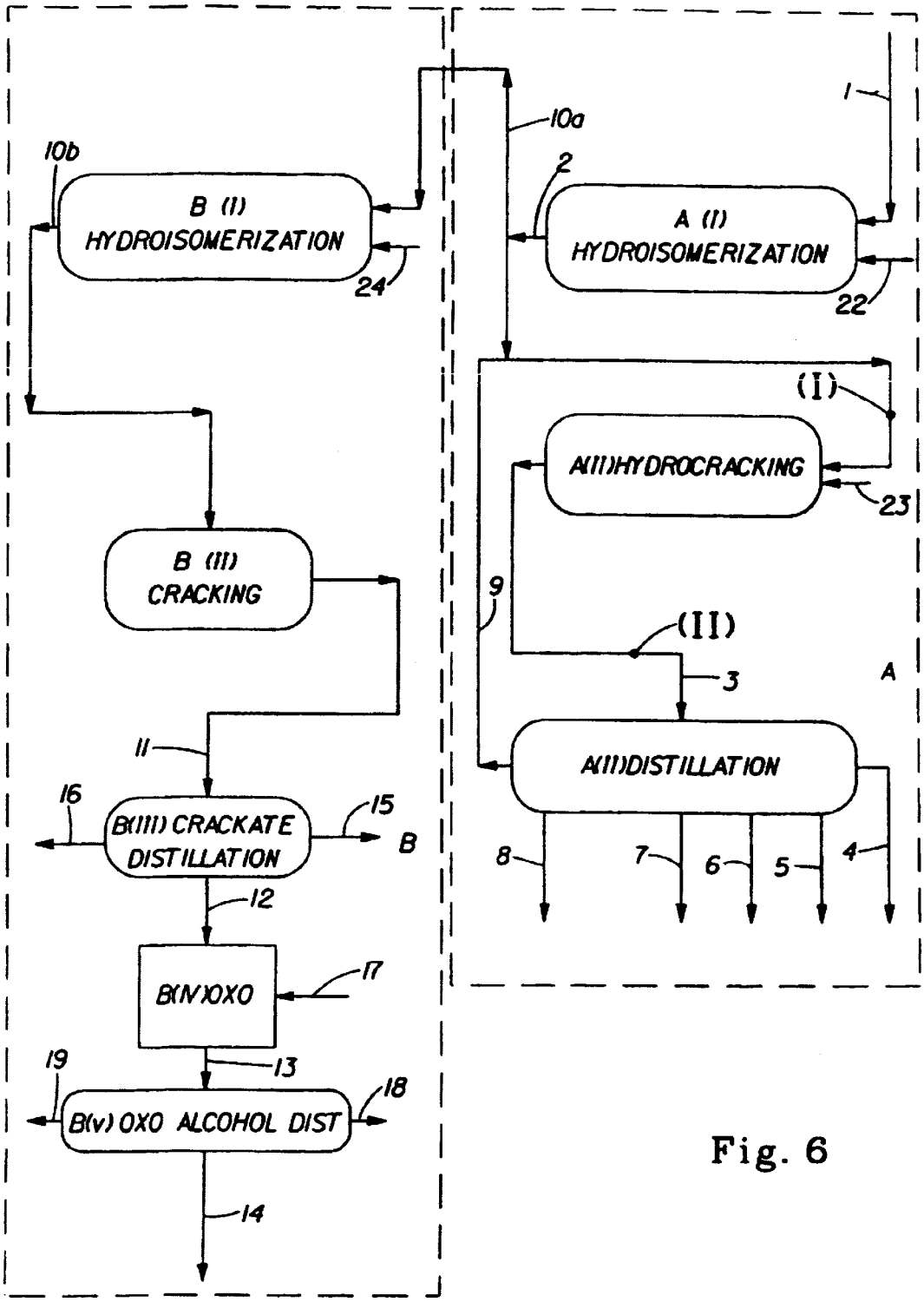
FIG. 6 is a flow diagram representing a process embodiment of the present invention having a wax isomerization unit.

FIG. 6 represents a process that has aspects, which are similar to those described in connection with FIG. 2, but also some important differences. A major difference is that isomerization is done as a wax. This requires an additional wax isomerization unit, B(i), the output stream 10*b* from which can be cracked in unit B(ii) to form highly branched alpha olefins, in stream 11. These are ideal for Oxo reaction by a non-isomerizing Oxo catalyst used in unit B(iv). Whereas in FIG. 2, the hydrocracking/hydroisomerization section of battery A is shown as one block, in FIG. 6, unit A(i) and unit A(ii) show isolated wax hydroisomerization and hydrocracking. One excellent source of hydrocrackages would be from lube making processes.

Preferred processes include those wherein stage (I) above includes providing an FISCHER-TROPSCH wax and hydroisomerizing/hydrocracking it as shown in battery A of FIGS. 2, 3, and 5. Likewise, preferred processes include those wherein stage (III) above is conducted as shown in the configurations of battery B in FIGS. 2, 3, and 5. Note in particular the Oxo reactor unit B(iv). With respect to delinearizing, (II) in the above-referenced process, see for example FIG. 2 or 3. It will be seen that these Figures show a pre-Oxo stage of cracking in the absence of added hydrogen in unit B(i) of battery B. This effectively produces chain-breaking and concurrent alpha-olefin formation. Isomerization of the olefins to give the requisite degree of branching, i.e., delinearizing, occurs in unit B(iii) in both of FIGS. 2 and 3. The sum of the cracking in unit B(i), the crackate distillation in unit B(ii), and the olefin isomerization in unit B(iii) accomplish all the needs of the above-identified stage (II), and prepare the product of the first stage for Oxo reaction in unit B(iv). In the discussion above, note that none of the stages, e.g., stage (II), are limited to one specific sequence, for example the sequence of FIG. 2 or 3. Other variations, for example, appear in FIGS. 4 and 6, which effectively also accomplish the needed delinearizing and preparing the product of the first stage for Oxo reaction, involving chain-breaking, branch-forming, and olefin-forming chemical reaction steps.

The present invention is not limited to one or another preferred process, but to further illustrate, the invention also includes a process as illustrated in FIG. 3, for making a fuel composition, the process comprising a step of blending: (a) from about 90% to about 99.9% of fuel hydrocarbons having from about 9 to about 20 carbon atoms (as produced for example from streams 6 or 7 of battery A of FIG. 3 combined with FISCHER-TROPSCH Oxo hydrocarbons present in stream 13 of battery B; and (b) from about 100 ppm to about 10% of nonlinear primary aliphatic Oxo alcohol derivatives, as produced by derivatizing the alcohols, for example from stream 13 of battery B of FIG. 3 to a nonlinear primary aliphatic derivative, wherein the nonlinear primary aliphatic derivatives are produced by the following stages:

(I) a first stage comprising: providing FISCHER-TROPSCH wax (stream 1 of FIG. 3), (II) a pre-Oxo stage comprising cracking the FISCHER-TROPSCH wax (in unit B(i) of FIG. 3) to an alpha-olefin/paraffin mixture (stream 10 of FIG. 3) and distilling the crackate (in unit B(ii) of FIG. 3) to produce a two-carbon to four-carbon olefin/paraffin cut (stream 11 of FIG. 3) and isomerizing the olefins of the olefin/paraffin cut (in unit B (iii) of FIG. 3) to form a pre-Oxo stage product of $C_1$-$C_3$ alkyl-branched, preferably methyl-branched olefins plus paraffins (stream 12 of FIG. 3); and (III) an Oxo/post-Oxo stage comprising converting the pre-Oxo stage product (stream 12 of FIG. 3) to the nonlinear Oxo alcohol, the Oxo/post-Oxo stage comprising at least one Oxo step with integral inclusion of an Oxo aldehyde to alcohol conversion step (all in unit B(iv) in FIG. 3). The product from unit B(iv) (stream 13 in FIG. 3) includes both the nonlinear primary aliphatic Oxo alcohols and one of the components of the final fuel, namely the FISCHER-TROPSCH Oxo hydrocarbon which is the paraffin referred to supra combined with limited amounts of paraffins produced by reduction in unit B(iv) of the isomerized olefin; and (IV) a derivatizing stage comprising derivatizing the nonlinear primary aliphatic Oxo alcohols by alkoxylating, etherifying, or esterifying by using methods well known in the art.

As an alternate process for running this process separately from any FISCHER-TROPSCH plant for the compositions of the present invention, like others processes described herein, may involve "piggybacking" onto a FISCHER-TROPSCH plant. See for example stream 4 from Battery A in FIG. 2. The compositions are prepared by using such a stream, rich in propylene/butylene. Thus the fuel compositions herein, for example those for use as jet or diesel fuel, include those which can be described as comprising the product of blending: (a) from about 90% to about 99.9% of fuel hydrocarbons having from about 9 to about 20 carbon atoms; and (b) nonlinear primary aliphatic Oxo alcohol derivatives, wherein the alcohol derivatives are the product of a process having: (I) a first stage comprising: providing a member selected from propylene/butylene monoolefin oligomers (optionally further comprising ethylene) having from 0.5 to 2.0 methyl groups per chain, the oligomers being prepared using molecular sieves selected from ZSM-23 and functional equivalents (in a battery not shown) to form a first stage product and (II) an Oxo/post-Oxo stage comprising at least one Oxo step and further optionally comprising an aldehyde to alcohol conversion step and (III) a derivatizing stage comprising derivatizing the nonlinear primary aliphatic Oxo alcohols by alkoxylating, etherifying, or esterifying by using methods well known in the art. Note that in this instance, the process of forming the nonlinear primary aliphatic derivative is nonintegral with the process of forming the fuel hydrocarbons With reference to FIG. 2, note that the production of the fuel hydrocarbons is absent from batteries A and B: it is prepared outside these batteries rather than being integrated into one or both of them.

Other Compositional Limits; Impurities

The present compositions can further be described in conjunction with various compositional limits, including limits on undesirable components or impurities. Compositional limits are described on a finished fuel basis unless otherwise specifically indicated.

Thus the invention includes a fuel composition having (by way of impurities) being substantially free or having a non-zero amount, e.g., at least one ppm, of at least one of the following:

from 1 ppm to no more than about 3% olefins: these typically include monoenes, dienes, etc.;

from 1 ppm to no more than about 15% monocyclic aromatics;

from 1 ppm to no more than about 2% $C_1$-$C_9$ carboxylates; and from 1 ppm to no more than 0.5% aldehydes.

All of these can be measured by well known methods, for example carboxylic acid impurities e.g., $C_1$-$C_9$ carboxylates can be measured by ASTM D130 Cu strip corrosion test or variation thereof, see for example U.S. Pat. No. 5,895,506.

Also encompassed is a composition wherein:

the first type of fuel hydrocarbons, (i), comprises from 0% to no more than about 10%, preferably up to about 5%, cyclic nonaromatics;

the second type of fuel hydrocarbons, (ii), comprises from 0% no more than about 10%, preferably up to about 5% cyclic nonaromatics; and the other type of fuel hydrocarbons, (iii), comprises at least 5% to 20%, more typically at least 10%, cyclic nonaromatics.

Fuel compositions herein preferably have at most low or zero levels of sulfur and/or nitrogen and/or polycyclic aromatics as analyzed on a finished fuel basis. Preferably the level of sulfur is no more than about 10 ppm, more preferably from 0 ppm to 5 ppm, on a finished fuel basis. Preferably the level of nitrogen is no more than about 50 ppm, more preferably from 0 ppm to at most 20 ppm, on a finished fuel basis. Typically the compositions have a total level of polycyclic aromatics, e.g., alkylnaphthalenes, of from 0 ppm to no more than about 50 ppm on a finished fuel basis. Certain highly preferred compositions are substantially free from olefins and carboxylates.

Other Optional Adjuncts

The invention also encompasses compositions further comprising: (g) from about 0.001 ppm to about 10%, more typically up to about 5%, of a fuel adjunct selected from (I) diesel adjuncts comprising diesel ignition improvers, diesel stability improvers, diesel corrosion inhibitors, diesel detergent additives, diesel cold flow improvers, diesel combustion improvers, diesel smoke and particulate mitigators, other conventional diesel adjuncts, and mixtures thereof; (II) aviation fuel adjuncts comprising jet fuel ignition improvers, jet fuel stability improvers, jet fuel corrosion inhibitors, jet fuel detergent additives, jet fuel cold flow improvers, jet fuel combustion improvers, jet fuel luminosity (particulate) reducers/radiation quenchers, jet fuel antimicrobial/antifungal adjuncts, jet fuel antistats, jet fuel smoke mitigators, other conventional jet fuel adjuncts and mixtures thereof.

Such adjuncts are known in the fuel-making art, see for example Kirk Othmer, Encyclopedia of Chemical Technology, Wiley, N.Y., 4th Ed., Vol. 3., pp. 788-812 (1992) and Vol. 12, pp. 373-388 (1994) and references therein. Percentages and proportions can be adjusted within ranges well known to formulators.

Other Embodiments and Ramifications

The invention encompasses concentrated fuel additives, i.e., "concentrates" wherein the fuel hydrocarbons are substantially free from hydrocarbons other than FISCHER TROPSCH-Oxo hydrocarbons.

The invention further encompasses compositions which are substantially free from native FISCHER-TROPSCH alcohols and/or their derivatives. A "native" FISCHER-TROPSCH alcohol is defined herein as an alcohol which is not formed in the Oxo stage of the present type of FISCHER-TROPSCH followed by Oxo process, but rather, is formed in an FISCHER-TROPSCH stage without an Oxo: See for example the art in background.) A problem with certain art-described described processes is an inability to make high levels of a nonlinear primary aliphatic Oxo alcohol independently from the hydrocarbon compositions.

The invention further encompasses compositions wherein the nonlinear primary aliphatic Oxo alcohol derivatives are substantially the only lubricity-improving component.

The invention also encompasses compositions, which are substantially free from diols and/or diol derivatives.

Products of the Process in More Detail

The invention encompasses novel mixtures, for example, nonlinear primary aliphatic alcohol-rich composition of stream 13 (see the FIGS. 2, 3, 5), wherein the alcohols can be derivatized in accordance with the present invention. This composition can, for example, comprise from about 20% to about 65% by weight of nonlinear primary aliphatic alcohols as defined hereinabove; preferably they are the product of substantially all-terminal hydroformylation in the Oxo stage. Depending on the cut taken in crackate distillation B(i) (see the FIGS. 2, 3, 5) and recalling that the Oxo process adds one carbon, the stream 13 alcohols can for example be $C_{12}$-$C_{15}$ primary Oxo alcohols when stream 13 is to be used in jet fuels, or $C_{14}$-$C_{17}$ primary Oxo alcohols when stream 13 is to be used in diesel fuels. Very highly preferred nonlinear primary aliphatic alcohols have a high proportion of mid-chain methyl branching, for example substantially all branching may be methyl and not ethyl or higher branching. The composition also comprises less than about 10% of diols, more typically from 1 ppm to about 1% of diols; typically these are branched alpha-omega-primary Oxo diols as defined hereinabove having two more carbon atoms than the diolefin intermediate from which it is derived. The composition may further comprise, for example, from 0% to about 5% of linear primary aliphatic Oxo alcohols. The alcohols and/or diols may be subsequently derivatized in accordance with the present invention.

The composition may further comprise less than about 0.1%, typically from 0 to 0.01% and preferably from about 0.001% or less of aldehydes; from about 35% to about 65% of FISCHER-TROPSCH Oxo hydrocarbons in paraffin form; from 0% to about 1% of FISCHER-TROPSCH Oxo hydrocarbons in olefin form; from 0% to about 1% of aromatics; less than about 10 ppm, to as low as undetectable amounts of sulfur; and less than about 20 ppm of nitrogen.

In FIGS. 2, 3, 5, and 6, stream 6 is a rather conventional stream but its composition needs to be described so as to further define another novel composition herein, namely blend stock 20. Thus, illustratively and non-limitingly, stream 6 is fuel hydrocarbon, more specifically FISCHER-TROPSCH non-Oxo hydrocarbons, in the form of a jet cut boiling at from about 160° C. (320° F.) to about 288° C. (550° F.) and comprising at least 95% by weight of the hydrocarbons as paraffins. Stream 6 has an iso- to normal-ratio of about 0.3 to about 3.0 and comprises, for example, at most 10 ppm sulfur and at most 20 ppm nitrogen, preferably less than 10 ppm of each; stream 6 comprises at most 1% unsaturates. The novel blend stock, 20, comprises a blend of streams 13 and 6 at a weight ratio of from about 1:1 to about 1:50.

Another novel composition herein is a jet fuel derived from streams 13 and 6, having the form of a mixture of streams 13 and 6 and comprising from about 0.1% to about 5%, more typically from about 0.1% to about 0.5% of alcohol derivatives in total; preferably in such compositions, any linear alcohol derivatives of stream 13 are present in the final fuel composition at a maximum level of about 1/10 of the total monoalcohol derivatives of stream 13. Thus the fuel is very rich in the desired mid-chain branched long-chain primary Oxo alcohol derivatives and very poor in linear Oxo alcohol derivatives.

Another illustrative novel fuel composition herein is substantially free from linear primary Oxo alcohol derivatives. Stream 7 is also a rather conventional stream but its composition needs to be described so as to further define yet another composition herein which is novel, namely blend stock 21. Thus, illustratively and non-limitingly, stream 7 is fuel hydrocarbon, more specifically FISCHER-TROPSCH non-Oxo hydrocarbons, in the form of a diesel cut boiling at from about 160° C. (320° F.) to about 371° C. (700° F.) and comprising at least 95% by weight paraffins. Stream 7 has an iso- to normal-ratio of about 0.3 to about 3.0 and comprises at most 10 ppm sulfur and at most 20 ppm nitrogen, preferably less than 10 ppm of each; stream 7 comprises at most 1% unsaturates and has a cetane number of greater than or equal to about 70. The novel blend stock, 21, comprises a blend of streams 13 and 7 at a weight ratio of from about 1:1 to about 1:50. Another novel composition of the invention is a diesel fuel derived from streams 13 and 7, having the form of a mixture of streams 13 and 7 and comprising from about 0.1% to about 1%, more typically from about 0.1% to about 0.5% of alcohol derivatives in total; preferably in such compositions, any linear alcohol derivatives of stream 13 are present in the final fuel composition at a maximum level of about 1/5 of the total monoalcohol derivatives ((a) and (c) of 13). Thus the diesel fuel is rich in the desired mid-chain branched long-chain primary Oxo alcohol derivatives and poor in linear Oxo alcohol derivatives.

Another illustrative diesel fuel composition is substantially free from linear primary Oxo alcohol derivatives. It should be understood and appreciated that the final jet and/or diesel fuel compositions given above are illustrative, thus it is equally possible, though not shown in the FIGS. 2, 3, 5, and 6, to blend stream 13 or the blend stocks 20 or 21 with hydrocarbons from other processes to complete fuel-making, leading to jet and/or diesel and/or turbine fuels. Such compositions are also believed to be novel and include, for example, from 0.1% to about 5%, more typically from about 0.1% to about 0.5% of the alcohol derivatives of 13 in total and, as major source of the hydrocarbons of the fuel, non-FISCHER-TROPSCH, non-Oxo fuel hydrocarbons in the form of hydrodesulfurized and preferably at least partially biodesulfurized hydrocarbons having poor lubricity, that is defined herein a having less than about 2500 grams in the scuffing BOCLE test (see U.S. Pat. No. 5,814,109). For hydrodesulfurization/biodesulfurization of fuel hydrocarbons, see U.S. Pat. No. 5,510,265, Oil & Gas Journal, Feb. 22, 1999, pp. 45-48 and Oil & Gas Journal, Apr. 28, 1997, pp. 56-65. Other primary sources of non-FISCHER-TROPSCH, non-Oxo fuel hydrocarbons can vary widely and can include, for example, hydrocarbons derived from heavy stocks by ring-opening of cyclohexyl- and/or cyclopentyl-moieties.

Compositions are likewise encompassed wherein the nonlinear primary aliphatic Oxo alcohol derivatives and the second type of fuel hydrocarbons have independently varying numbers of carbon atoms and degrees of branching. Degree of branching is defined and discussed hereinabove. Further, to better understand this aspect of the invention, refer to FIG. 2. In FIG. 2, the degree of branching of the second type of fuel hydrocarbons is determined in process unit A(i). These fuel hydrocarbons are separated by boiling-point in process section A(ii). This provides control of the number of carbon atoms. For the alcohol moieties of the nonlinear primary aliphatic derivatives, the degree of branching is determined by the aggregate effect of process units B(iii) and B(iv). The boiling point is a consequence of process unit B(ii).

Also included are compositions wherein the second type of fuel hydrocarbons has a broader range of number of carbon atoms than the alcohol moieties of the nonlinear primary aliphatic Oxo alcohol derivatives. This aspect of the invention can likewise be understood by reference to the nonlimiting illustrations in the FIGS. 2, 3, 5 and 6. This aspect is a matter of choice, made possible by the independence of batteries A and B. The choice of broad range, for example, for economic reasons, is thereby made possible.

In certain preferred compositions, the second type of fuel hydrocarbon has a lesser degree of branching than the alcohol moieties of the nonlinear primary aliphatic Oxo alcohol derivatives, preferably by at least 0.2 mole fraction. For example, so as to secure diesel fuel compositions wherein the cetane number is maximized while the low temperature fluidity is superior compared to art-used linear alcohol derivatives, one would like to minimize the degree of branching in the fuel hydrocarbon, since linear paraffins have a higher cetane value than the corresponding branched paraffins. Using the present invention, therefore, battery A production of fuel hydrocarbons permits the isolation of desirably linear (low branching) paraffins, while battery B permits the introduction of sufficient and somewhat higher branching (compared to the corresponding paraffins) into the alcohols and/or alcohol derivatives to achieve superior low temperature properties. An analogous situation obtains for jet fuel, except that smoke point replaces cetane number as the second controlled parameter.

Method and Use Embodiments

The present invention has numerous method and use embodiments, which can be dependent on or independent from the process by which the compositions described are made. Thus the invention includes all use of branched long-chain primary Oxo alcohol derivatives, preferred types being preferred nonlinear primary aliphatic derivatives as described above, as low-temperature and/or lubricity-improving additives for fuels, more particularly jet, diesel or turbine fuels; use of branched long-chain primary Oxo alcohol derivatives in intermediate compositions or blend-stocks for such fuels; and various more specific uses, such as the use of branched long-chain primary Oxo alcohol derivatives in fuels for automobile diesel engines, especially new, small diesel engines under development. The corresponding uses of compositions such as stream 13 in FIGS. 2, 3, 5 and 6, defined as product of the present processes, is likewise encompassed.

In the use embodiments of the present invention, there is encompassed herein use of any of the compositions described herein as a dual-use jet/diesel concentrated additive or blend stock.

Also encompassed in the present invention is a method of use of any of the compositions described herein comprising a step of combusting the same, as fuel in a jet engine or in a compression ignition engine, i.e., a diesel engine.

Further encompassed is a method of use of any of the compositions described herein comprising a step of combusting the composition as fuel in a vehicle having a power system consisting of a 10,000 psi (70 MPa) or greater direct injection diesel engine, preferably of the common rail type, or a hybrid power system comprising the engine and an electric motor. In a preferred method, the method additionally comprises a step of storing the composition in a tank and a step of passing the composition from the tank to the engine, wherein, the composition is pumpable at temperatures down to about −10° C., or lower.

In addition, the invention includes a method of use of a composition of the invention, comprising a step of passing the composition from a fuel tank at temperatures down to about −47° C., or lower, to a jet engine followed by a step of combusting the composition as fuel in the jet engine at elevated altitudes and/or at low ambient temperatures.

The methods herein further include a method of biodegrading a fuel comprising (i) selecting a composition of the invention; and (ii) disposing of the composition, optionally in presence of soils and/or microorganisms. This method is envisaged in view of the fact that persons using the invention may suffer occasional, accidentals spills, leaks etc. and/or may wish to make use of environmental services companies, or the like, to dispose of unwanted or at least unrecoverable fuel compositions in accordance with the invention. The fuels of the present invention can be conveniently disposed of in any permitted manner or location where biodegradation of the undesired composition may proceed. Unlike oxygenates such as MTBE, the present nonlinear primary aliphatic derivatives have low water solubility and are biodegradable. Moreover the present nonlinear primary aliphatic derivatives have excellent low toxicity. These properties are helpful in widely used fuels.

Further the present invention envisages use of fuel compositions of the present invention as fuel for an engine selected from two-cycle and four-cycle engines having a compression ratio of from 5:1 to 40:1; or as fuel in jet or turbine engines utilizing flame or surface combustion.

The present invention further includes a method of transporting a composition of the present invention, comprising pumping the composition in a pipeline under low ambient temperature conditions, e.g., extreme arctic conditions.

The present invention has numerous other embodiments and ramifications, including compositions which are not necessarily optimal in terms of performance. For example, the nonlinear primary aliphatic derivative component of the present compositions can comprise $C_{18}$ nonlinear primary aliphatic derivative in combination with one or more other nonlinear primary aliphatic derivatives, for example from a four-carbon cut which includes $C_{16}$ nonlinear primary aliphatic derivative or $C_{17}$ nonlinear primary aliphatic derivative.

Advantages

The present invention has numerous advantages. It allows transportation of concentrates as pumpable homogeneous liquids from a few purpose-built plants to supply worldwide clean jet/diesel needs. Since certain process streams herein can also be used for detergents, the invention has the potential to make all manner of cleaning compositions, especially surfactants, using compounds from these streams more affordable for the consumer.

The new processes herein are simple and can use known process units, with a need only to connect or configure them in the novel ways taught herein. The processes thus require a minimum of additional new process development and are very practical. Unexpected process unit combinations herein include piggyback cracking (based on very old detergent art) on processes having modern hydrocracking/hydroisomerization (based on recent lubricant-making art. See for example S. J. Miller, Microporous Materials, Vol. 2 (1994), pp. 439-449.

The processes of the present invention utilize what are potentially the best and largest commercial sources of mid-chain methyl-branched paraffins worldwide, and flexibly accommodate the use of leading-edge technologies for making the main stream. There is little or no waste, since all byproducts from the side-stream(s) can be used or returned to the main stream of the fuel plant at a value equal or greater than on receipt.

Preferred embodiments of the process, which include FISCHER TROPSCH paraffin making in the main stream of the fuel plant, have an Oxo reaction, which can use substantially the same synthesis gas or $H_2$/CO ratio as the FISCHER TROPSCH paraffin making. The compositions produced have numerous advantages. The products of the present processes are unexpectedly superior for improving low temperature properties and fuel lubricity, permitting clean (low sulfur and nitrogen) fuels yet having them be effective in the lubrication of fuel injectors and pumps. The nonlinear primary aliphatic derivatives in the present invention indeed have excellent surface properties at metal surfaces of components of internal combustion engines, especially in frictionally affected situations.

Most importantly, the specific long-chain branched primary Oxo alcohol derivatives produced herein have excellent low-temperature properties and significant lubricity-enhancing power for jet, diesel and turbine fuels. This is very important in view of various technological and environmental pressures to remove the inherent sulfur-based, nitrogen-based and aromatic based lubricity improvers from such fuels.

Moreover the present long-chain branched primary Oxo alcohol derivatives are especially useful for use in new, cleaner, small diesel engines being developed for use in automobiles. Thus, not only in its process embodiments, but also in its composition and method of use embodiments as described below, the present invention has high and significant value.

SYNTHESIS EXAMPLES

Example 1

Acetate Ester is Made by a Base Catalyzed Transesterification of a Branched, Fatty Alcohol with Ethyl Acetate.

Add 150 g (0.60 mol) of $C_{16}$-$C_{17}$ mid-chain branched alcohol of the present invention, 1-L ethyl acetate, and 13 g (0.06 mol) of 25% sodium methoxide in methanol. Let stir at room temperature overnight (17-19 hrs). Removed ethyl acetate by reduced pressure rotary evaporation. Add 1-L fresh ethyl acetate and 13 g additional 25% sodium methoxide. Let stir overnight again as described above to allow reaction to complete. Acetate ester of the $C_{16}$-$C_{17}$ mid-chain branched alcohol of the present invention is obtained.

Example 2

Alcohol Ethoxylate is Made by Mixing a Branched, Fatty Alcohol with Ethylene Oxide Gas in the Presence of Sodium Metal.

Add 350 g (1.40 mol) of $C_{16}$-$C_{17}$ mid-chain branched alcohol of the present invention and heat alcohol to 90° C. under a nitrogen blanket. Add 1.62 g (0.07 mol) of sodium metal. Continue heating to 130° C. and cease nitrogen flow and add the ethylene oxide gas to the alcohol/sodium metal mixture while stirring. Alcohol ethoxylate of the $C_{16}$-$C_{17}$ mid-chain branched alcohol of the present invention is obtained.

Example 3

Branched Alcohol Ester is Made by Mixing a Branched, Fatty Alcohol with Ethyl Acetate via a Base Catalyzed Transesterification Add 150 g (0.60 mol) of $C_{14}$-$C_{15}$ mid-chain branched alcohol of the present invention, 1-L ethyl acetate, and 13 g (0.06 mol) of 25% sodium methoxide in methanol. Let stir at room temperature overnight (17-19 hrs). Removed ethyl acetate by reduced pressure rotary evaporation. Add 1-L fresh ethyl acetate and 13 g additional 25% sodium methoxide. Let stir overnight again as described above to allow reaction to complete. Acetate ester of Neodol 45 alcohol is obtained. The carboxylic acid may be selected from the group consisting of: mono-, di-, tri-or tetra-carboxylic acids and mixtures thereof. The carboxylic acid may be selected from the group consisting of: succinic acid, citric acid, adipic acid, lactic acid, tartaric acid, phthallic acid, malic acid, maleic acid, glutaric acid, phosphoric acid, phosphorous acid, butane-1,2,3,4-tetracarboxylic acid, salicylic acid, alpha-hydroxy acid and mixtures thereof.

Example 4

Branched Alcohol Ether are Made by Mixing Branched, Fatty Alcohol with Diisobutylaluminum Hydride in the Presence of Methylene Chloride To 173.5 g (0.69 mol) $C_{16}$-$C_{17}$ mid-chain methyl branched alcohol of the present invention in 150 ml methylene chloride by an ice water bath, drip in 342.3 g of 25% (in toluene) diisobutylaluminum hydride over a period of 2.75 hours. Let mix and come to RT then drip in 35.7 g (0.46 mol) glycidol keeping temperature at 30-35° C. After exotherm, let stir for 72 hours at 25° C. Chill mixture and add 324 g of aqueous potassium-sodium tartrate (Rochelle's salt) and add 200 ml methylene chloride. Place in separatory funnel and add 500 ml ethyl acetate. Take organic layer and extract 2× with water, dry with $Na_2SO_4$ then filter through Celite. Chromatograph with silica gel column using 80:20 chloroform:ether to elute starting branched alcohol then use 98:2 ether:methanol to recover the glycerol ether. Obtain 28.5 g of clear, slightly yellow, somewhat viscous liquid (glycerol ether). The branched alcohol ethers may comprise a glycerol or polyglycerol ether.

Example 5

Branched Carboxylic Acids are Made by Mixing Branched, Fatty Alcohol with Hydrogen Peroxide in the Presence of Sodium Tungstate, Tricaprylmethylammonium Chloride, and Sulfuric Acid 0.5 mol of a mid-chain branched alcohol of the present invention is treated with 1.5 moles of 30% hydrogen peroxide, 0.01 mol of sodium tungstate, 0.02 mol of tricaprylmethylammonium chloride, and 0.002 mol sulfuric acid. Heat with stirring to 80° C. for 6 hours. Cool and separate layers. Dissolve organic layer into 250 ml hexane. Wash two times with 200 ml each of saturated bisulfite solution. Rotary evaporate to recover a yellow liquid.

Example 6

Three (3) moles of a branched carboxylic acid of the present invention is mixed with 1 mol of glycerin and 10 grams of AMBERLYST® 15 (Rohm & Haas). The mixture is heated under vacuum with stirring to 95° C. for 6 hours. The product is cooled and the AMBERLYST® 15 is separated by filtration.

Example 7

3-($C_{16-17}$ Branched Alkoxy) Propionic Acid is Made by a Two Step Process

Step 1: Making the nitrile ether intermediate

To 82.5 g (0.33 mol) $C_{16-17}$ branched alcohol is added 2.4 g of 40% aqueous potassium hydroxide. 17.51 g (0.33 mol) acrylonitrile is dripped in and the mixture is gently heated to 30° C., the mixture then exotherms to about 38° C. Acrylonitrile is added over a period of about 30 minutes. Stir the mixture 7-20 hours at 25° C. The yellowish, slightly hazy mixtures is chromatographed using 96:4 methylene chloride:ethyl aceate eluent to obtain a clear, colorless nitrile ether intermediate.

Step 2: Hydrolysis of the nitrile to the carboxylic acid

To 78 ml of water add 234 g concentrated sulfuric acid, stir and cool. Add 15.6 g sodium chloride. Heat and star dripping in 39.0 g (0.13 mol) of the nitrile ether intermediate compound. When foaming occurs, control with an ice water bath and continue heating. The cooling/heating cycle is continued as necessary until all the nitrile ether intermediate has been added. About 40 ml of water is added during the cooling/heating cycle to control viscosity. Heat is applied as the mixture thickens to reflux the mixture for 2.5-3.0 hours. Place in a separatory funnel and remove the aqueous acid and salt (clear bottom layer). Add water and methylene chloride to the separatory funnel and remove the aqueous layer. Was the organic layer with water and then dry with sodium sulfate. Filter the organic layer. Chromatograph with 85:15 hexane:ethyl acetate to remove nonpolar impurities. Elute the final acid compound with 90:10 ethyl acetate: acetone eluent. The chromatographically purified final acid compound has a pour point of −2° C.

Example 8

Reaction of Succinic Anhydride with $C_{16,17}$ Mid-chain Branched Alcohol to Make a Monoester To 78.6 g (0.31 mol) of $C_{16,17}$ mid-chain branched alcohol that has been heated to 60° C. is added 28.6 g (0.28 mol) succinic anhydride. The mixture is heated to 150° C. and stirred for about 5 hours. The mixture is chromatographed with a silica gel column using 80:20 hexane:ethyl acetate eluant to elude the diester. Then a 90:10 ethyl acetate: acetone eluant is used to recover the monoester. The chromatographically purified monoester has a pour point of −3° C.

Example 9

Reaction of Phthalic Anhydride with $C_{16,17}$ Mid-chain Branched Alcohol of the Present Invention to Make a Monoester To 69.3 g (0.28 mol) of $C_{16,17}$ mid-chain branched alcohol of the present invention, which has been heated to 60° C., add 37.3 g (0.25 mol) phthalic anhydride. Heat the mixture to 135° C. and stir for about 2 hours. Chromatograph the mixture with a silica gel column using a 96:4 methylene chloride: acetone eluant to elute first the diester and then the purified monoester. The chromatographically purified monoester has a pour point of −33° C. The comparable linear hexdecyl ortho monophthalate has a melting point of 62° C.

Example 10

Reaction of Glycidol with a Mid-chain Branched Alcohol of the Present Invention to Make a Glycerol Ether To 173.5 g (0.69 mol) of a mid-chain branched alcohol of the present invention in 150 mL methylene chloride chilled by an ice water bath, drip in 342.3 g of 25% (in toluene) diisobutylaluminum hydride over a period of 2.75 hours. Let the mixture come to about 25° C., then drip in 35.7 g (0.46 mol) glycidol, while keeping the temperature of the mixture from about 20-35° C. After exotherm, let stir for 72 hours at 25° C. Chill the mixture an add 324 g of aqueous potassium-sodium tartrate (Rochelle's salt) and add 200 mL methylene chloride. Place the mixture in a separatory funnel and add 500 mL ethyl acetate. Take the organic layer and extract twice with water. Dry the organic layer with Na2So4 and filter through celite. Chromatograph with a silica gel column using 80:20 chloroform:ether eluant to elute the starting alcohol then use 98:2 ether:methanol to recover the glycerol ether. The chromatographically purified glycerol ether has a pour point of −39° C.

What is claimed is:

1. A fuel composition for internal combustion engines, said fuel composition comprising:

(a) at least about 5% of one or more fuel hydrocarbons; and (b) at least about 10 ppm of one or more nonlinear primary aliphatic alcohol derivatives, wherein the alcohol moieties of said one or more nonlinear primary aliphatic alcohol derivatives have at least about 11 carbon atoms and having the formula:

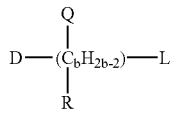

wherein $C_bH_{2b-2}$ is a linear saturated hydrocarbyl and D, L, Q and R are substituents; D is $CH_3$, b is an integer selected such that the total carbon content of the alcohol moiety of said nonlinear primary aliphatic alcohol derivatives are from about 11 to about 21 carbon atoms, L is a moiety having the general formula:

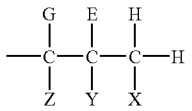

wherein one of X and Y and Z is in independently selected from the group consisting of:

1) $CH_2OC(O)R'$ wherein R' is selected from H, $CH_3$, $CH_2CH_3$, $CH_2CH_2CH_3$, $CH_2OH$, $CHOHCH_3$, $CH{=}CHC(O)OH$, $CH_2CH_2C(O)OH$, or $C_6H_5C(O)OH$;
2) $CH_2O(alkoxy)_nH$, n represents an average of alkoxy units and has a value of from about 0.01 to about 5;
3) $CH_2OCH_2CH(OH)CH_2OCH_2CH(OH)CH_2OH$;
4) $CH_2OCH_2CH_2C(O)OH$; and
5) mixtures thereof;

any of X and Y and Z which is not independently selected from the group consisting of $CH_2OC(O)R'$ wherein R' and n are defined as above; $CH_2O(alkoxy)_nH$; $CH_2OCH_2CH(OH)CH_2OCH_2CH(OH)CH_2OH$; $CH_2OCH_2CH_2C(O)OH$ and mixtures thereof, is H; E, G and Q are selected from H, methyl, ethyl, propyl butyl, and mixtures thereof provided that E, G and Q are not all H and such that no carbon atoms are quaternary; R is selected from the group consisting of H, methyl ethyl, propyl, butyl, and mixtures thereof.

2. The fuel composition according to claim 1 wherein:

(a) said one or more fuel hydrocarbons comprise at least two types of fuel hydrocarbons; and (b) wherein said one or more nonlinear primary aliphatic alcohol derivatives comprise a nonlinear primary aliphatic Oxo alcohol derivative, wherein at least about 0.6 weight fraction of the alcohol moiety of said one or more nonlinear primary aliphatic Oxo alcohol derivative comprises at least one $C_1$-$C_3$ alkyl substituent situated on a third or higher carbon atom counting from an Oxo alcohol moiety hydroxy group.

3. The fuel composition according to claim 2 wherein said at least two types of fuel hydrocarbons are differentiated in that a first type of fuel hydrocarbon is a FISCHER-TROPSCH Oxo hydrocarbon and a second type of fuel hydrocarbon is other than said first type of fuel hydrocarbon.

4. The fuel composition according to claim 1 comprising: from about 5% to about 99.9990% of said one or more fuel hydrocarbons and from about 10 ppm to about 95% of said one or more nonlinear primary aliphatic alcohol derivatives; wherein said one or more fuel hydrocarbons comprise FISCHER-TROPSCH Oxo hydrocarbons; and the alcohol moieties of said one or more nonlinear primary aliphatic alcohol derivatives have an average of from about 11 to about 21 carbon atoms; and wherein said composition further comprises a member selected from the group consisting of:

(c) linear monoalcohols or linear monoalcohol derivatives;

(d) nonlinear diols or nonlinear diol derivatives;

(e) linear diols or linear diol derivatives; and (f) mixtures of two or more of (c)-(e).

5. The fuel composition according to claim 4 wherein the fuel composition comprises components (b) and (c) at a (b):(c) ratio of at least about 2:1 by weight.

6. The fuel composition according to claim 1 wherein an additive pour point, $APP_I$, of component (b) is at least 10° C. below the additive pour point $APP_R$, of a reference alcohol composition consisting essentially of the corresponding linear primary aliphatic alcohol derivatives.

7. The fuel composition according to claim 1 comprising from about 20% to about 95% of said one or more nonlinear primary aliphatic alcohol derivatives; and wherein said one or more fuel hydrocarbons, (a), comprise:

(i) from about 5% to about 80% of a first type of fuel hydrocarbons selected from FISCHER-TROPSCH Oxo hydrocarbons;

and wherein at least 0.8 weight fraction of said alcohol moieties of said one or more nonlinear primary aliphatic alcohol derivatives comprises at least one $C_1$-$C_3$ alkyl substituent situated on a third or higher carbon atom counting from the alcohol moiety hydroxy group; and not more than about 0.01 weight fraction of the alcohol moieties of said one or more nonlinear primary aliphatic alcohol derivatives comprises a quaternary substituted carbon atom.

8. The fuel composition according to claim 1 comprising from about 0.1% to about 19% of said one or more nonlinear primary aliphatic alcohol derivatives; and wherein said one or more fuel hydrocarbons, (a), comprise:

(i) from about 0.05% to about 18% of a first type of fuel hydrocarbons selected from FISCHER-TROPSCH Oxo hydrocarbons;

(ii) from about 80% to about 99% of a second type of fuel hydrocarbons selected from FISCHER-TROPSCH non-Oxo hydrocarbons;

wherein at least 0.8 weight fraction of the alcohol moieties of said one or more nonlinear primary aliphatic alcohol derivatives comprises at least one $C_1$-$C_3$ alkyl substituent situated on a third or higher carbon atom counting from the alcohol moiety hydroxy group; and not more than about 0.001 weight fraction of the alcohol moieties of said one or more nonlinear primary aliphatic alcohol derivatives comprises a quaternary substituted carbon atom.

9. The fuel composition according to claim 8 having a ratio of said second type of fuel hydrocarbons to said first type of fuel hydrocarbons of at least about 10:1 by weight.

10. A fuel composition for internal combustion engines, said fuel composition comprising:

(a) at least about 5% of fuel hydrocarbons comprising:

(i) from about 1 ppm to about 10% of a first type of fuel hydrocarbons having from about 10 to about 20 carbon atoms selected from FISCHER-TROPSCH Oxo hydrocarbons;

(ii) from 0% to about 99% of a second type of fuel hydrocarbons selected from FISCHER-TROPSCH non-Oxo hydrocarbons having at least about 5 carbon atoms and (iii) from 0% to about 99% of at least one other type of fuel hydrocarbons having at least about 5 carbon atoms other than (a)(i) and (a)(ii), provided that when present, the sum of (a)(ii) and (a)(iii) is at least about 80% by weight of the fuel hydrocarbons;

(b) at least about 10 ppm of one or more nonlinear primary aliphatic alcohol derivatives, wherein the alcohol moieties of said one or more nonlinear primary aliphatic alcohol derivatives have at least about 11 carbon atoms wherein at least 0.6 weight fraction of the alcohol moieties of said one or more nonlinear primary aliphatic alcohol derivatives comprises at least one $C_1$-$C_3$ alkyl substituent situated on a third or higher carbon atom counting from the alcohol moiety hydroxy group; and not more than about 0.01 weight fraction of the alcohol moieties of said one or more nonlinear primary aliphatic alcohol derivatives comprise a quaternary substituted carbon atom;

(c) at least about 0.001 ppm of linear primary Oxo alcohol derivatives having at least 11 carbon atoms; and wherein said fuel composition has:

(I) when (a)(iii) is present, a ratio by weight {(a)(ii)+(a)(iii)}:(a)(i) of at least about 10:1;

(II) a ratio by weight (b):(a) of at least about 1:10, and (III) from zero ppm to about 50 ppm of sulfur.

11. The fuel composition according to claim 10 wherein said component, (a)(iii), comprises at least 0.1 weight fraction saturated cyclic hydrocarbons; whereas said components, (a)(i) and (a)(ii), each comprise less than 0.05 weight fraction of saturated cyclic hydrocarbons.

12. The fuel composition according to claim 10 such that said fuel composition has i) a flow point of −25° C. or below;

ii) a sulfur content of less than about 50 ppm; and iii) a aromatic content of less than about 10%.

13. The fuel composition according to claim 10 wherein said one or more fuel hydrocarbons comprise from about 9 to about 14 carbon atoms.

14. The fuel composition according to claim 13 wherein said fuel composition has i) a flow point of −47° C. or below; and ii) a smoke point of at least 18 mm wick.

15. The fuel composition according to claim 10 wherein said one or more fuel hydrocarbons comprise from about 5 to about 14 carbon atoms.

16. The fuel composition according to claim 15 wherein said fuel composition further has i) a flow point of −10° C. or below, ii) a sulfur content of less than 50 ppm; and iii) an aromatic content of less than about 10%.

17. The fuel composition according to claim 1 having the form of a concentrated fuel additive comprising: from about 5% to about 90% of said one or more fuel hydrocarbons and from about 10% to about 95% of said one or more nonlinear primary aliphatic alcohol derivatives; wherein said one or more fuel hydrocarbons are derived from FISCHER-TROPSCH wax, petroleum wax or mixtures thereof; and the alcohol moieties of said one or more nonlinear primary aliphatic alcohol derivatives is in the form of a two-carbon alcohol cut selected from a $C_{12}$-$C_{13}$ cut, a $C_{14}$-$C_{15}$ cut, and a $C_{16}$-$C_{17}$ cut.

18. The fuel composition according to claim 1 having the form of a concentrated fuel additive comprising: from about 5% to about 90% of said one or more fuel hydrocarbons and from about 10% to about 95% of said one or more nonlinear primary aliphatic alcohol derivatives; wherein said one or more fuel hydrocarbons are derived from FISCHER-TROPSCH wax, petroleum wax or mixtures thereof, and the alcohol moieties of said one or more nonlinear primary aliphatic alcohol derivatives is in the form of a four-carbon cut selected from a $C_{14}$-$C_{17}$ cut.

19. The fuel composition according to claim 1 wherein said one or more nonlinear primary aliphatic alcohol derivatives have the general formula:

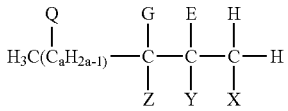

wherein one of X and Y and Z is independently selected from the group consisting of:

1) $CH_2OC(O)R'$ wherein R' is selected from H, $CH_3$, $CH_2CH_3$, $CH_2CH_2CH_3$, $CH_2OH$, $CHOHCH_3$, $CH{=}CHC(O)OH$, $CH_2CH_2C(O)OH$, or $C_6H_5C(O)OH$;

2) $CH_2O(alkoxy)_nH$, n represents an average of alkoxy units and has a value of from about 0.01 to about 5;

3) $CH_2OCH_2CH(OH)CH_2OCH_2CH(OH)CH_2OH$;

4) $CH_2OCH_2CH_2C(O)OH$; and 5) mixtures thereof;

any of X and Y and Z which is not independently selected from the group consisting of $CH_2OC(O)R'$ wherein R' and n are defined as above; $CH_2O(alkoxy)_nH$; $CH_2OCH_2CH(OH)CH_2OCH_2CH(OH)CH_2OH$; $CH_2OCH_2CH_2C(O)OH$ and mixtures thereof, is H; E, G and Q are selected from H and methyl provided that at least one of E, G and Q is methyl and such that no carbon atoms are quaternary; the moiety $C_aH_{2a-1}$ is a liner saturated hydrocarbyl; and a is an integer selected such that the total carbon content of the alcohol moiety of said alcohol derivative is from about 11 to about 21.

20. The fuel composition according to claim 1 wherein said one or more nonlinear primary aliphatic alcohol derivatives have the general formula:

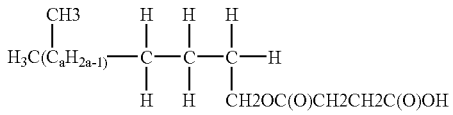

wherein a is an integer selected such that the total carbon content of the alcohol moiety of alcohol derivative is from about 11 to about 21.

21. The fuel composition according to claim 1 wherein said one or more nonlinear primary aliphatic alcohol derivatives have the general formula:

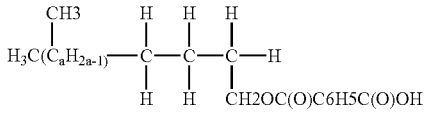

wherein a is an integer selected such that the total carbon content of the alcohol moiety of alcohol derivative is from about 11 to about 21 and the carbonyl is at the ortho-, meta- or para-position.

22. The fuel composition according to claim 1 wherein said one or more nonlinear primary aliphatic alcohol derivatives have the general formula:

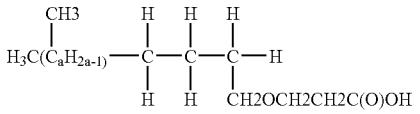

wherein a is an integer selected such that the total carbon content of the alcohol moiety of alcohol derivative is from about 11 to about 21.

23. The fuel composition according to claim 1 further comprising at least one of the following components:

i) from about 1 ppm to about 3% olefins;

ii) from about 1 ppm to about 15% monocyclic aromatics;

iii) from about 1 ppm to about 2% $C_1$-$C_9$ carboxylates; and iv) from about 1 ppm to about 0.5% aldehydes.

24. The fuel composition according to claim 1 wherein said one or more nonlinear primary aliphatic alcohol derivatives are substantially free from methyl butanol, methyl butanol derivatives, ethylhexanol, ethylhexanol derivatives, propylheptanols, propylheptanol derivatives, aminoalcohols, amino alcohol derivatives, aromatic alcohols, aromatic alcohol derivatives, glycols having linear hydrocarbon chains, glycol derivatives having linear hydrocarbon chains, alcohols comprising the aldol condensation product of aldehydes, alcohol derivatives comprising the aldol condensation product of aldehydes; alcohols comprising the Oxo product of linear internal olefins, alcohol derivatives comprising the Oxo product of linear internal olefins, and alcohols comprising quaternized carbon and consisting of the Oxo product of acid-catalyzed propylene/butylenes oligomerization, and alcohol derivatives comprising quaternized carbon and consisting of the Oxo product of acid-catalyzed propylene/butylene oligomerization.

25. The fuel composition according to claim 1 having from 0 ppm to 10 ppm of sulfur, nitrogen, or polycyclic aromatics as analyzed on a finished fuel basis.

26. The fuel composition according to claim 1 wherein said fuel composition has from 0 ppm to about 50 ppm of sulfur on a finished fuel basis.

27. The fuel composition according to claim 1 wherein said fuel composition has from 0 ppm to about 50 ppm of nitrogen on a finished fuel basis.

28. The fuel composition according to claim 1 wherein said fuel composition has from 0 ppm to about 50 ppm of polycyclic aromatics on a finished fuel basis.

29. The fuel composition according to claim 1 wherein said fuel composition is substantially free from olefins and $C_1$-$C_9$ carboxylates.

30. The fuel composition according to claim 1, wherein said one or more fuel hydrocarbons are substantially free from hydrocarbons other than FISCHER-TROPSCH-Oxo hydrocarbons.

31. The fuel composition according to claim 1 wherein said fuel composition is substantially free from native FISCHER-TROPSCH alcohols and/or their derivatives.

32. The fuel composition according to claim 1 wherein said one or more nonlinear primary aliphatic alcohols are monohydric.

33. The fuel composition according to claim 1 wherein said one or more nonlinear primary aliphatic alcohols are substantially free from diols and/or their derivatives.

34. The fuel composition according to claim 1 wherein said fuel composition further comprises:

(c) from about 0.001 ppm to about 30% of liner $C_{11}$ to $C_{21}$ alcohols, linear $C_{11}$ to $C_{21}$ alcohol derivatives, and mixtures thereof.

35. The fuel composition according to claim 1 further comprising:

(d) from about 0.001 ppm to about 30% of $C_{12}$ to $C_{22}$ nonlinear primary aliphatic diol derivatives.

36. The fuel composition according to claim 1 further comprising (e) from about 0.0001 ppm to about 3% of $C_{12}$ to $C_{22}$ linear primary aliphatic diol derivatives.

37. The fuel composition according to claim 1 further comprising (f) from about 0.001 ppm to about 30% of a mixture of members selected from: linear $C_{11}$ to $C_{21}$ alcohols, linear $C_{11}$ to $C_{21}$ alcohol derivatives; $C_{12}$ to $C_{22}$ nonlinear primary aliphatic diols, $C_{12}$ to $C_{22}$ nonlinear primary aliphatic diols derivatives; and $C_{12}$ to $C_{22}$ linear primary aliphatic diols, $C_{12}$ to $C_{22}$ linear primary aliphatic dial derivatives.

38. The fuel composition according to claim 1 further comprising:

(g) from about 0.001 ppm to about 10% of a fuel adjunct selected from the group consisting of:

(I) diesel adjuncts comprising diesel ignition improvers, diesel stability improvers, diesel corrosion inhibitors, diesel detergent additives, diesel cold flow improvers, diesel combustion improvers, other conventional diesel adjuncts, or mixtures thereof; and (II) aviation fuel adjuncts comprising jet fuel ignition improvers, jet fuel stability improvers, jet fuel corrosion inhibitors, jet fuel detergent additives, jet fuel cold flow improvers, jet fuel combustion improvers, jet fuel luminosity reducers/radiation quenchers, jet fuel antimicrobial/antifungal adjuncts, jet fuel antistats, other conventional jet fuel adjuncts, or mixtures thereof.

* * * * *